US011483660B2

(12) United States Patent
Wang et al.

(10) Patent No.: US 11,483,660 B2
(45) Date of Patent: Oct. 25, 2022

(54) SOUND PRODUCTION APPARATUS AND PORTABLE TERMINAL

(71) Applicant: GOERTEK INC., Shandong (CN)

(72) Inventors: Xinglong Wang, Shandong (CN); Guodong Zhao, Shandong (CN); Lianshan Ge, Shandong (CN); Chunfa Liu, Shandong (CN)

(73) Assignee: Goertek, Inc., Weifang (CN)

( * ) Notice: Subject to any disclaimer, the term of this patent is extended or adjusted under 35 U.S.C. 154(b) by 0 days.

(21) Appl. No.: 17/256,343

(22) PCT Filed: Dec. 29, 2018

(86) PCT No.: PCT/CN2018/125584
§ 371 (c)(1),
(2) Date: Dec. 28, 2020

(87) PCT Pub. No.: WO2020/000985
PCT Pub. Date: Jan. 2, 2020

(65) Prior Publication Data

US 2021/0266673 A1 Aug. 26, 2021

(30) Foreign Application Priority Data

Jun. 25, 2018 (CN) ..... 201810667413.3

(51) Int. Cl.
*H04R 9/06* (2006.01)
*H04R 1/28* (2006.01)
*H04R 9/02* (2006.01)

(52) U.S. Cl.
CPC ..... *H04R 9/06* (2013.01); *H04R 1/2811* (2013.01); *H04R 9/025* (2013.01); *H04R 2400/11* (2013.01)

(58) Field of Classification Search
CPC ..... H04R 11/02; H04R 7/18; H04R 2400/03; H04R 2400/11; H04R 7/14; H04R 31/006; H04R 2307/027
See application file for complete search history.

(56) References Cited

U.S. PATENT DOCUMENTS 8,774,447 B2 * 7/2014 Ko ..... H04R 9/06 381/396
2005/0221867 A1 * 10/2005 Zurek ..... H04R 1/323 455/569.1

(Continued)

FOREIGN PATENT DOCUMENTS

CN 102333270 A 1/2012
CN 105681983 A 6/2016

(Continued)

*Primary Examiner* — Alexander Krzystan
*Assistant Examiner* — Julie X Dang
(74) *Attorney, Agent, or Firm* — Baker Botts, L.L.P.

(57) ABSTRACT

The present invention discloses a sound production apparatus, comprising a first vibration system, a second vibration system and a magnetic circuit system, wherein the first vibration system comprises a first diaphragm and a voice coil arranged on a side, facing the magnetic circuit system, of the first diaphragm; the second vibration system comprises a second diaphragm arranged opposite to the first diaphragm, and a middle position of the second diaphragm is combined with a reinforcement portion; the reinforcement portion is provided with an extension portion extending along a direction close to the first diaphragm, and a position, corresponding to the extension portion, in the magnetic circuit system is provided with an avoidance portion; and the extension portion is capable of passing through the avoidance portion, and is fixed to the first diaphragm. The sound production apparatus of the present invention is configured with two sets of vibration systems but only adopts one set of a voice coil and magnetic circuit system, so as to realize a (Continued)

structure for synchronized bidirectional sound production, occupying a small volume, facilitating its wide application to portable terminals.

18 Claims, 23 Drawing Sheets

(56) References Cited

U.S. PATENT DOCUMENTS

| | | | | |
|---|---|---|---|---|
| 2012/0070022 | A1* | 3/2012 | Saiki | H04R 9/063 381/351 |
| 2014/0112512 | A1* | 4/2014 | Su | H04M 1/026 381/333 |
| 2014/0348349 | A1* | 11/2014 | Nagaoka | H04R 1/288 381/162 |
| 2015/0110329 | A1* | 4/2015 | Tanaka | H04R 1/10 381/380 |
| 2016/0021441 | A1* | 1/2016 | Shao | H04R 1/24 381/412 |
| 2016/0080870 | A1* | 3/2016 | Vieites | H04R 7/18 181/153 |
| 2016/0165352 | A1* | 6/2016 | Zheng | H04R 9/025 381/412 |
| 2017/0347204 | A1* | 11/2017 | Linghu | H04R 7/14 |

FOREIGN PATENT DOCUMENTS

| | | | | |
|---|---|---|---|---|
| CN | 106303857 | A | | 1/2017 |
| CN | 206118013 | U | * | 4/2017 |
| CN | 206118013 | U | | 4/2017 |
| CN | 108632729 | A | | 10/2018 |
| CN | 108924709 | A | | 11/2018 |

* cited by examiner

SOUND PRODUCTION APPARATUS AND PORTABLE TERMINAL

CROSS-REFERENCE TO RELATED APPLICATIONS

This application is a National Stage of International Application No. PCT/CN2018/125584, filed on Dec. 29, 2018, which claims priority to Chinese Patent Application No. 201810667413.3, filed on Jun. 25, 2018, both of which are hereby incorporated by reference in their entireties.

TECHNICAL FIELD

The present disclosure relates to the technical field of sound production, in particular to a sound production apparatus and a portable terminal.

BACKGROUND

At present, sound production apparatuses as important parts of terminals with audio play functions have been applied widely. Some terminals, in particular portable terminals, for example, mobile phones, tablet computer and earphones, provide quite limited mounting spaces for sound production apparatuses, thus, existing sound production apparatuses capable of being applied to narrow mounting spaces are usually of structures of producing sounds from front surfaces by single diaphragms. In order to achieve bidirectional sound production, provided is a sound production apparatus employing two sets of voice coil and magnetic circuit systems. However, such sound production apparatus which is usually large in size can be hardly applied widely.

SUMMARY

The present invention aims to provide a sound production apparatus to solve the technical problem that the existing sound production apparatus producing bidirectional sounds which is large in size can be hardly applied widely.

In order to achieve the purpose, the sound production apparatus provided by the present invention comprises a first vibration system, a second vibration system and a magnetic circuit system, wherein the first vibration system comprises a first diaphragm and a voice coil arranged on the side, facing the magnetic circuit system, of the first diaphragm;

the second vibration system comprises a second diaphragm arranged opposite to the first diaphragm, and a middle position of the second diaphragm is combined with a reinforcement portion; the reinforcement portion is provided with an extension portion extending along a direction close to the first diaphragm, and a position, corresponding to the extension portion, in the magnetic circuit system is provided with an avoidance portion; and the extension portion is capable of passing through the avoidance portion, and is fixed to the first diaphragm.

Optionally, the second diaphragm comprises a central portion located in the middle position, a corrugated rim portion located on an outer side of the central portion and a fixation portion integrally provided with the corrugated rim portion, the reinforcement portion comprising a reinforcement portion body, the reinforcement portion body being attached to the central portion and the extension portion being formed by extending from an outer edge of the reinforcement portion body.

Optionally, the reinforcement portion is combined to a side, facing the magnetic circuit system, of the central portion, and the extension portion movably passes through the avoidance portion to be extended fixed to the first diaphragm; or the reinforcement portion is combined to a side, away from the magnetic circuit system, of the central portion, the second diaphragm is further provided with a mounting hole where the extension portion passes through, and the extension portion movably passes through the avoidance portion to be extended fixed to the first diaphragm.

Optionally, the reinforcement portion body and the extension portion are of an integrated structure.

Optionally, the reinforcement portion body is provided with a wavy reinforcing stiffener structure formed by at least one bump and at least one recess.

Optionally, the central portion is of a planar sheet structure and provided with a material removal hole, and the bump of the wavy reinforcing stiffener structure is accommodated in the material removal hole.

Optionally, the second diaphragm is rectangular, and the reinforcing stiffener structure is arranged to extend along a length direction of the second diaphragm.

Optionally, the extension portion is provided with a reinforcing rib on at least one of two opposite side portions in a circumferential direction of the reinforcement portion body, and the reinforcing rib is fixedly connected to the reinforcement portion body.

Optionally, the extension portion comprises a main body portion extending upward from the reinforcement portion body and a first folding portion, the first folding portion is formed by being folded inwardly from an upper edge of the main body portion, and the first folding portion is attached to the first diaphragm and fixedly connected to the first diaphragm.

Optionally, the extension portion further comprises a second folding portion formed by being folded outwardly from an upper edge of the main body portion, and the second folding portion is attached to the first diaphragm and is fixedly connected to the first diaphragm.

Optionally, the extension portion is provided with a reinforcing stiffener extending in an up-down direction.

Optionally, a plurality of extension portions are provided, and the plurality of extension portions are symmetrically arranged with respect to a center of the voice coil.

Optionally, the extension portions are arranged corresponding to a periphery of the voice coil.

Optionally, the corrugated rim portion of the second diaphragm comprises a plurality of corrugated rim structures, and any adjacent two corrugated rim structures have opposite depression directions.

Optionally, the magnetic circuit system further comprises a central magnetic circuit portion and a side magnetic circuit portion arranged on a magnetic conductive yoke, the central magnetic circuit portion comprising stripe-type central magnetic steel;

the side magnetic circuit portion comprises two side magnetic steels, the two side magnetic steels being separately arranged on two sides of the central magnetic steel, and magnetic gaps being formed between the central magnetic steel and the two side magnetic steels; and two extension portions are provided, the two extension portions being arranged to correspond to a periphery of two side edges of the central magnetic steel, separately.

Optionally, the magnetic conductive yoke is of a rectangular flat plate structure, the two side magnetic steels being arranged on two long side edges of the magnetic conductive yoke, the avoidance portion being an avoidance notch formed on a short side edge of the magnetic conductive yoke, and the extension portion passing through from the avoidance notch; or the magnetic conductive yoke is of the rectangular flat plate structure, the two side magnetic steels being arranged on two short side edges of the magnetic conductive yoke, the avoidance portion being an avoidance notch formed on a long edge side of the magnetic conductive yoke, and the extension portion passing through from the avoidance notch.

Optionally, the magnetic circuit system is arranged in a circular ring shape.

Optionally, the sound production apparatus further comprises an outer shell, and a first electric connector and a second electric connector arranged on the outer shell, wherein the first electric connector comprises a first internal bonding pad and a first external bonding pad arranged integrally;

the second electric connector comprises a second internal bonding pad and a second external bonding pad arranged integrally;

and the first external bonding pad and the second external bonding pad are electrically connected to an external circuit, two leading wires of the voice coil being electrically connected to the first internal bonding pad and the second internal bonding pad, separately.

Optionally, the outer shell is arranged in a rectangular shape, a short shaft side of the outer shell being provided with a protrusion portion protruding from the outer shell and the first external bonding pad and the second external bonding pad being located on the protrusion portion.

Optionally, the outer shell is arranged in an annular shape, a side surface of the outer shell being provided with a protrusion portion protruding from the outer shell and the first external bonding pad and the second external bonding pad being located on the protrusion portion.

Optionally, the magnetic circuit system is arranged between the first diaphragm and the second diaphragm, and the voice coil is accommodated in a magnetic gap of the magnetic circuit system, a first sound cavity being formed between the magnetic circuit system and the first diaphragm and a second sound cavity being formed between the magnetic circuit system and the second diaphragm.

The present invention further provides a portable terminal, comprising a housing, the housing being provided with an accommodation cavity internally, the portable terminal characterized by further comprising the sound production apparatus mentioned above, the sound production apparatus being mounted in the accommodation cavity, and the housing being provided with a first sound hole corresponding to the first diaphragm and a second sound hole corresponding to the second diaphragm.

Optionally, the housing is provided with a front surface and a back surface that are arranged oppositely, the first sound hole being formed in the front surface and the second sound hole being formed in the back surface.

The sound production apparatus of the present invention is configured with two sets of vibration systems but adopts only one set of a voice coil and magnetic circuit system, so as to realize a structure for bidirectional sound production occupying a small volume, facilitating its wide application to portable terminals. When the sound production apparatus of the present invention works, first of all the magnetic circuit system drives the voice coil directly, and the voice coil drives the first diaphragm of the first vibration system to vibrate, so that air in the first sound cavity is compressed or dilated to produce sound, and meanwhile, the reinforcement portion connected to the first diaphragm is driven to further drive the second diaphragm to vibrate, so that air in the second sound cavity is compressed or dilated to produce sound. The second sound cavity is dilated or compressed in a linked manner, such that one voice coil drives the first diaphragm and the second diaphragm to vibrate simultaneously to produce bidirectional sound. Therefore, the first vibration system and the second vibration system are connected simultaneously to form a linking system so as to achieve a bidirectional radiate sound production function. When applied to the portable terminal, the sound production apparatus of the present invention can produce sound synchronously through the first vibration system and the second vibration system separately toward forward and backward directions of the portable terminal.

BRIEF DESCRIPTION OF THE DRAWINGS

In order to illustrate embodiments of the present invention or technical solutions in the prior art more clearly, brief introduction on drawings needed to be used in description of the embodiments or the prior art is made below. It is obvious that the drawings described below are merely some embodiments of the present invention. Those skilled in the art further can obtain other drawings in accordance with structures shown in the drawings without creative efforts.

Drawing reference signs.

Figure 1:
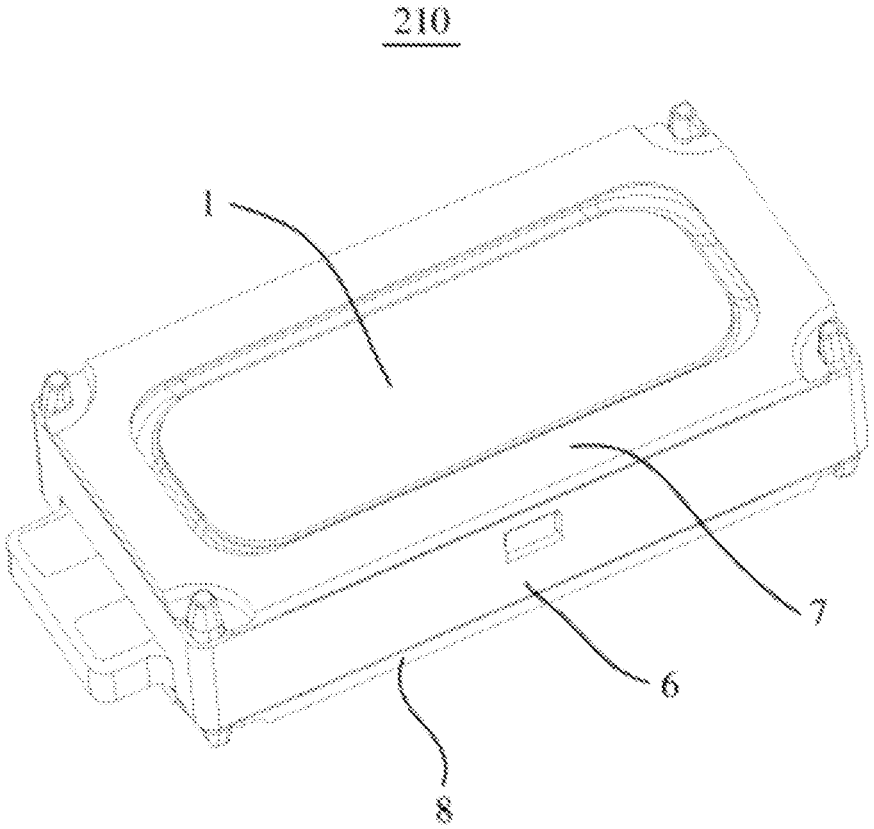
FIG. 1 is a front surface structure schematic diagram of an embodiment of a sound production apparatus of the present invention.
Figure 2:
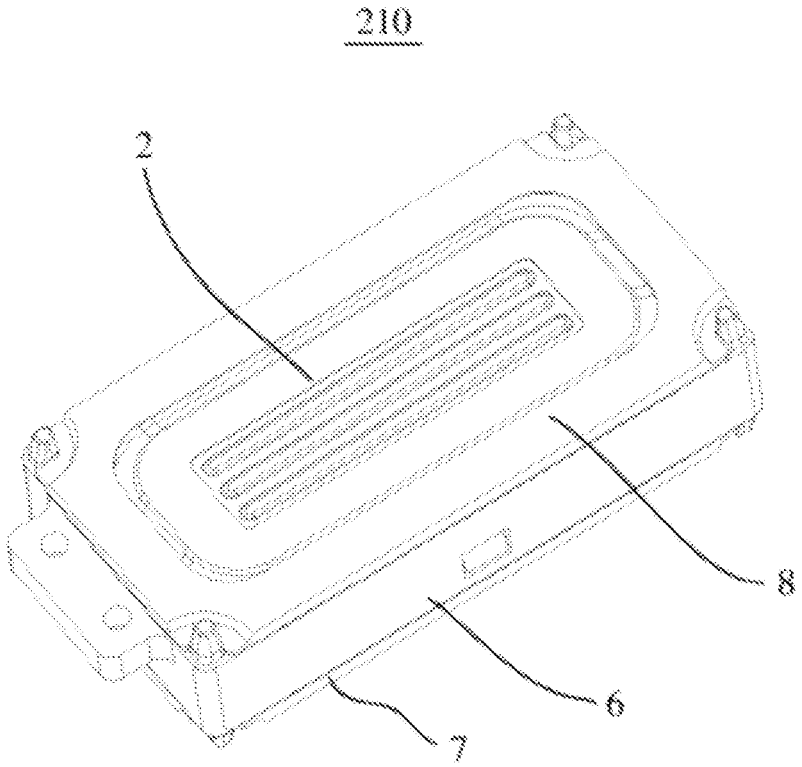
FIG. 2 is a back surface structure schematic diagram of a sound production apparatus in the FIG. 1.

| Drawing reference signs | Name |
|---|---|
| 1 | First vibration system |
| 11 | First diaphragm |
| 12 | Voice coil |
| 121 | Leading wire |
| 2 | Second vibration system |
| 21a, 21b | Second diaphragm |
| 211 | Central portion |
| 2111 | Material removal hole |
| 212a, 212b | Corrugated rim portion |
| 213 | Fixation portion |
| 214a, 214b | Reinforcement portion |
| 2141a, 2141b | Reinforcement portion body |
| 2141c, 2141d | Reinforcement portion body |
| 2142 | Extension portion |
| 2143 | Main body portion |
| 321 | First electric connector |
| 3211 | First internal bonding pad |
| 3212 | First external bonding pad |
| 3213 | Connecting portion |
| 322 | Second electric connector |
| 3221 | Second internal bonding pad |
| 3222 | Second external bonding pad |
| 2144 | First folding portion |
| 2145 | Second folding portion |
| 2146a, 2146b | Reinforcing stiffener structure |

-continued

| Drawing reference signs | Name |
|---|---|
| 2146c, 2146d | Reinforcing stiffener structure |
| 2147 | Connecting groove |
| 2148 | Reinforcing rib |
| 3 | Magnetic circuit system |
| 31 | Magnetic gap |
| 33 | Magnetic conductive yoke |
| 331 | Avoidance portion |
| 34 | Central magnetic steel |
| 342 | Side magnetic steel |
| 35 | Magnetic conductive plate |
| 4 | First sound cavity |
| 5 | Second sound cavity |
| 6 | Outer shell |
| 7 | Front cover |
| 71 | Front sound outlet hole |
| 8 | Back cover |
| 81 | Rear sound outlet hole |
| 100 | Portable terminal |
| 110 | Housing |
| 120 | Accommodation cavity |
| 130 | First sound hole |
| 140 | Second sound hole |
| 210 | Sound production apparatus |

Further description on implementation of purposes, functional characteristics and advantages of the present invention is made in combination with embodiments with reference to drawings.

DETAILED DESCRIPTION

Clear and intact description on the technical solutions in the embodiments of the present invention will be made in combination with drawings in the embodiments of the present invention. It is obvious that the embodiments described are only a part of embodiments of the present invention, and are not all of embodiments thereof. Based on the embodiments of the invention, all the other embodiments obtained by those of ordinary skill in the art without inventive effort are within the scope of the invention.

It should be noted that all directional indications (for example, upper, lower, left, right, front, rear and etc.) in the embodiments are merely used for explaining relative position relationships and moving conditions and etc. between parts in a certain special gesture (as shown in the drawings). The directional indications change as well therewith when the special gesture changes.

In addition, the descriptions of "first", "second" and the like in the present disclosure are used for the purpose of description only, and are not to be construed as indicating or implying their relative importance or implicitly indicating the number of technical features indicated. Thus, features defined with "first", "second" may include at least one such feature, either explicitly or implicitly. Furthermore, the technical solutions between the various embodiments may be combined with each other, but must be on the basis that the combination thereof can be implemented by a person of ordinary skill in the art. In case of a contradiction with the combination of the technical solutions or a failure to implement the combination, it should be considered that the combination of the technical solutions does not exist, and is not within the protection scope of the present invention.

In the present invention, unless otherwise explicitly specified and stated, terms such as "connection" and "fixation" shall be understood in a broad sense, for example, "connect" can be either fixed connection or detachable connection or integrated connection, can be either mechanical connection or electrical connection, can be either direct connection or indirect connection through an intermediate medium, and can be communication in two elements or interaction relationship of two elements, unless otherwise explicitly stated herein. Those of ordinary skill in the art may understand the specific meaning of terms in this disclosure according to specific circumstance.

The present invention provides a sound production apparatus. With reference to FIG. 1 to FIG. 3 and FIG. 20, in an embodiment, the sound production apparatus 210 comprises a first vibration system 1, a second vibration system 2 and a magnetic circuit system 3, wherein the first vibration system 1 comprises a first diaphragm 11 and a voice coil 12 arranged on the first diaphragm 11 facing the magnetic circuit system 3;

the second vibration system 2 comprises second diaphragms (21*a*, 21*b*) arranged opposite to the first diaphragm 11, the second diaphragms (21*a*, 21*b*) comprising central portions 211 and reinforcement portions (214*a*, 214*b*);

The magnetic circuit system 3 is arranged between the first diaphragm 11 and the second diaphragm (21*a*, 21*b*), the voice coil 12 being accommodated in a magnetic gap 31 of the magnetic circuit system 3; a first sound cavity 4 is formed between the magnetic circuit system 3 and the first diaphragm 11, and a second sound cavity 5 is formed between the magnetic circuit system 3 and the second diaphragm (21*a*, 21*b*);

extension portions 2142 are arranged on the reinforcement portions (214*a*, 214*b*), and parts, corresponding to the extension portions 2142, of the magnetic conductive yoke 33 on the magnetic circuit system 3 are provided with avoidance portions 331; and the reinforcement portions (214*a*, 214*b*) are combined on the central portions 211 and the extension portions 2142 movably pass through the avoidance portions 331 and are extended fixed to the first diaphragm 11.

In the embodiment, in order to simplify description, upper and lower sides are defined with reference to the position of the first diaphragm 11 of the sound production apparatus 210 when placed upward, i.e. the side, back facing the magnetic circuit system 3, of the first diaphragm 11 is the upper side and the side, facing the magnetic circuit system 3, of the first diaphragm 11 is the lower side.

The first vibration system 1 can be referred to an existing form. In particular, the voice coil 12 is fixedly connected to the first diaphragm 11 and extends into the magnetic gap 31, the voice coil 12 with currents switched on is subjected to different Ampere forces to vibrate, and the voice coil 12 vibrates to drive the first diaphragm 11 to vibrate, so that the energy conversion mode is electric energy-mechanical energy-sound energy.

The form of the magnetic circuit system 3 can be also referred to an existing structure, for example, the magnetic gap 31 can be formed either between the central magnetic steel 34 and the side magnetic steel 342 or between the central magnetic steel 34 and the side wall of the magnetic conductive yoke 33. The overlook shape of the central magnetic steel 34 can be either roundness or rounded rectangle and etc.

In order to easily mount the first vibration system 1, the second vibration system 2 and the magnetic circuit system 3 between the first vibration system 1 and the second vibration system 2, the sound production apparatus 210 further comprises a housing 6, a front cover 7 and a back cover 8. The housing 6 is used for accommodating the first vibration system 1, the second vibration system 2 and the magnetic circuit system 3. The front cover 7 and the back cover 8 are matched with the housing 6 to form a protecting frame. In particular, an edge portion of the first diaphragm 11 for fixation is clamped by the front cover 7 and the housing 6, and edge portions of the second diaphragms (21*a*, 21*b*) for fixation are clamped by the back cover 8 and the housing 6. The front cover 7 is arranged corresponding to the first vibration system 1 and is provided with a front sound outlet hole 71 where sound exits and the back cover 8 is arranged corresponding to the second vibration system 2 and is provided with a rear sound outlet hole 81 where sound exits.

In the embodiment, the reinforcement portions (214*a*, 214*b*) are arranged to mainly increase the rigidity of the second diaphragm 21*a*, reduce the segmenting vibration and improve the high frequency performance. Preferably, in order to guarantee a better sound production performance of the passively radiated second diaphragm 21*a*, the reinforcement portions (214*a*, 214*b*) are made from materials with high specific modulus, for example, a composite material, aluminum, an aluminum magnesium alloy, a magnesium lithium alloy, carbon fibers, PEN (polyethylene naphthalate), LCP (Liquid Crystal Polymer), a foaming body and the like.

The first diaphragm 11 and the second diaphragms (21*a*, 21*b*) can produce sound in a human audio response range, for example, the frequency range is 20-20000 HZ, and therefore, a user can receive sound information directly from forward an backward directions of the sound production apparatus. It can be understood that in other embodiments, the first diaphragm 11 and the second diaphragms (21*a*, 21*b*) further can be used for producing sounds in other frequency ranges, for example, "sound password" in a corresponding human ear audio range, and the sound can be decoded by a machine to achieve corresponding signal transmission.

In order to facilitate mounting and connection of the reinforcement portions (214*a*, 214*b*), the reinforcement portions (214*a*, 214*b*) in the embodiments are located on the inner sides (i.e. the sides facing the magnetic circuit system) of the second diaphragms (21*a*, 21*b*), such that the extension portion 2142 of the reinforcement portions (214*a*, 214*b*) only need to pass through the avoidance portions 331 to be extended fixed to the first diaphragm 11. It is easy to mount and the volumes of the reinforcement portions (214*a*, 214*b*) can be reduced.

Surely, in another embodiment of the present invention, the reinforcement portions (214*a*, 214*b*) are combined to the outer side of the central portions 211, the second diaphragms (21*a*, 21*b*) are provided with mounting holes (not shown) where the extension portions 2142 pass through, and the extension portions 2142 movably pass through the avoidance portions 331 and are extended fixed to the first diaphragm 11. This arrangement is taken as an achievable mode. The reinforcement portions (214*a*, 214*b*) are combined to the outer sides of the central portions 211, the extension portions 2142 of the reinforcement portions (214*a*, 214*b*) pass through the mounting holes and the avoidance portions 331 successively and are connected to the first diaphragm 11, and similarly, the voice coil 12 vibrates to drive the two diaphragms, i.e. the first diaphragm 11 and the second diaphragms (21*a*, 21*b*) to vibrate to produce sounds so as to achieve a purpose that the bidirectional sound production structure occupies a small volume.

The sound production apparatus 210 of the present invention is configured with two sets of vibration systems but only adopts one set of a voice coil 12 and magnetic circuit system 3, thereby realizing a compact volume of the bidirectional sound production structure and facilitating its wide application to the portable terminal 100. When the sound production apparatus 210 of the present invention works, first of all the magnetic circuit system 3 drives the voice coil 12 directly, and the voice coil 12 drives the first diaphragm 11 of the first vibration system 1 to vibrate, so that air in the first sound cavity 4 is compressed or dilated to produce sound, and meanwhile, the reinforcement portions (214*a*, 214*b*) connected to the first diaphragm are driven to further drive the second diaphragms (21*a*, 21*b*) to vibrate, so that air in the second sound cavity 5 is compressed or dilated to produce sound. The second sound cavity 5 is dilated or compressed in a linked manner, such that one voice coil 12 drives the first diaphragm 11 and the second diaphragms (21*a*, 21*b*) to vibrate simultaneously to produce bidirectional sound. Therefore, the first vibration system 1 and the second vibration system 2 are connected simultaneously to form a linking system so as to achieve a bidirectional radiate sound production function. When applied to the portable terminal 100, the sound production apparatus 210 of the present invention can produce sound synchronously through the first vibration system 1 and the second vibration system 2 separately toward forward and backward directions of the portable terminal 100.

Preferably, in order to balance pressures and temperatures and the like inside and outside the sound production apparatus, at least one damp hole is further formed in the side surface of the housing 6 of the sound production apparatus, and a damping can be pasted to the damp hole.

Figure 7:
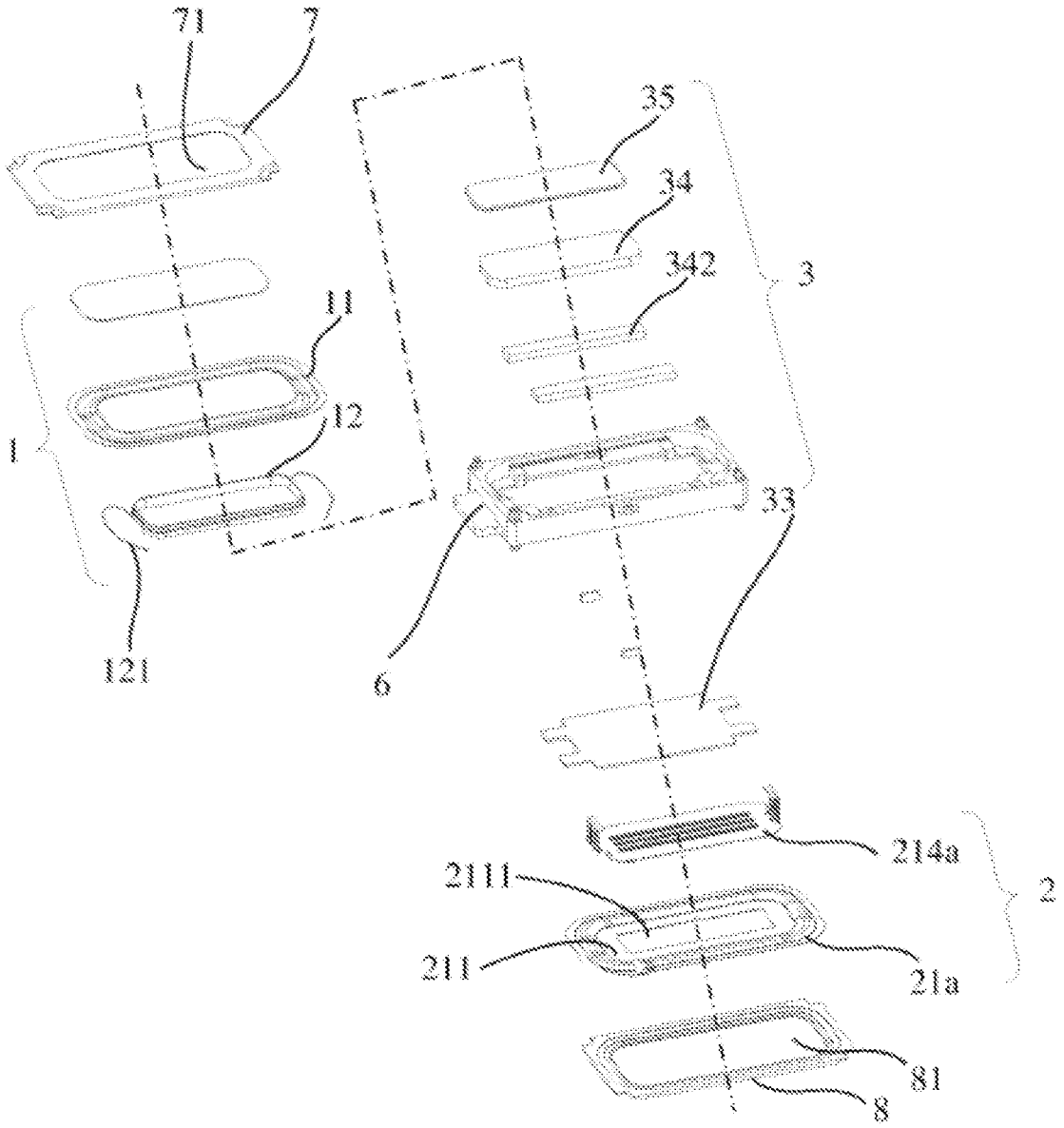
FIG. 7 is an explosive structural schematic diagram of a sound production apparatus in the FIG. 1, wherein a first embodiment of a magnetic circuit system is shown.
Figure 8:
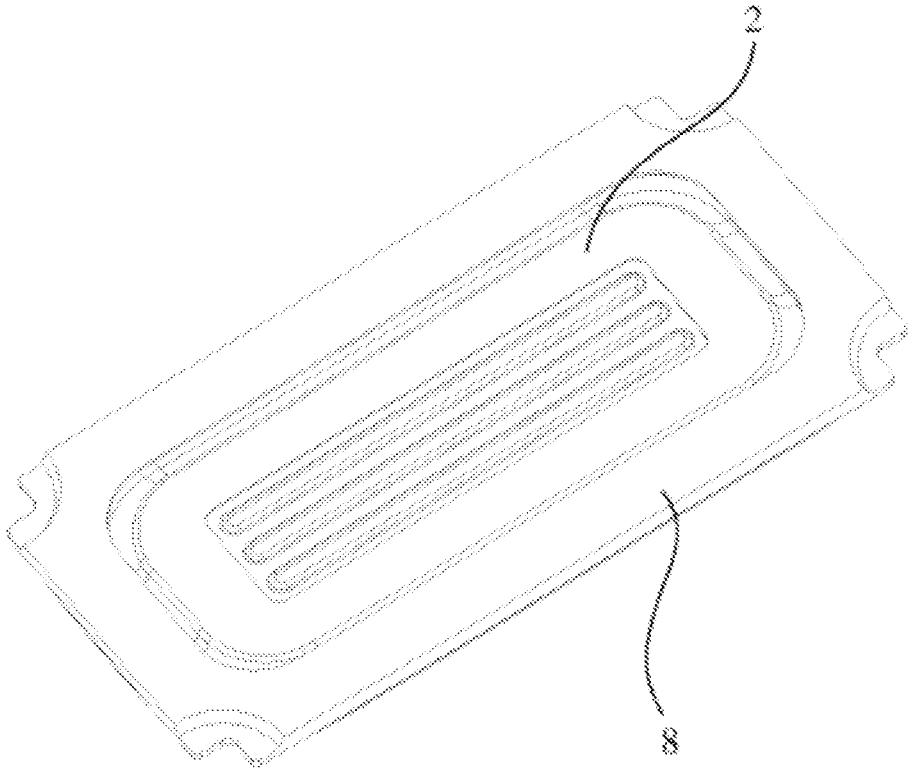
FIG. 8 is a connection back surface structure schematic diagram between a back cover and a second vibration system of a sound production apparatus in the FIG. 2.
Figure 9:
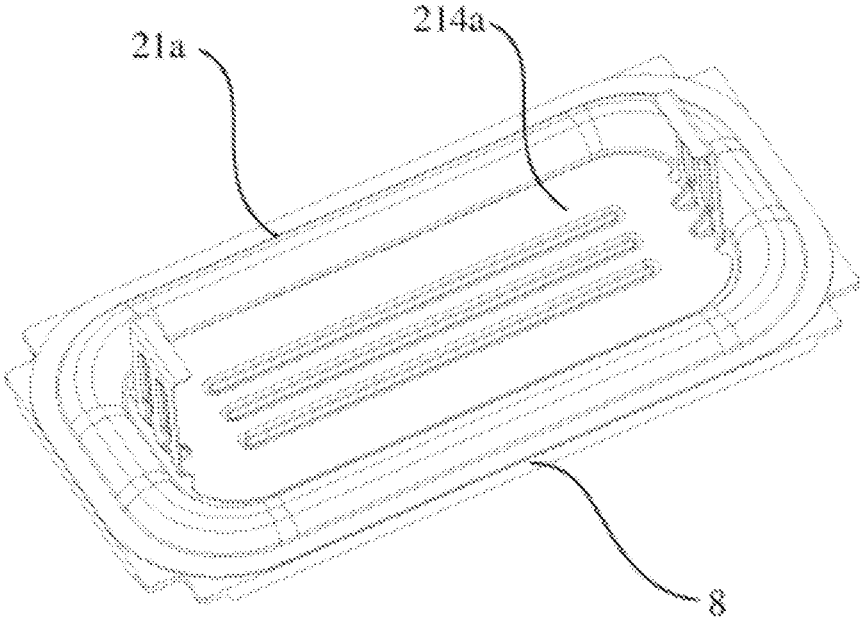
FIG. 9 is a connection front surface structure schematic diagram between a back cover and a second vibration system of a sound production apparatus in the FIG. 8.
Figure 14:
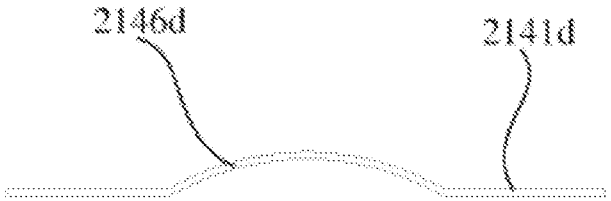
FIG. 14 is yet another sectional schematic diagram of the reinforcement portion body in the FIG. 10, wherein a first embodiment of the reinforcement portion body is replaced by a fourth embodiment of the reinforcement portion body.
Figure 15:
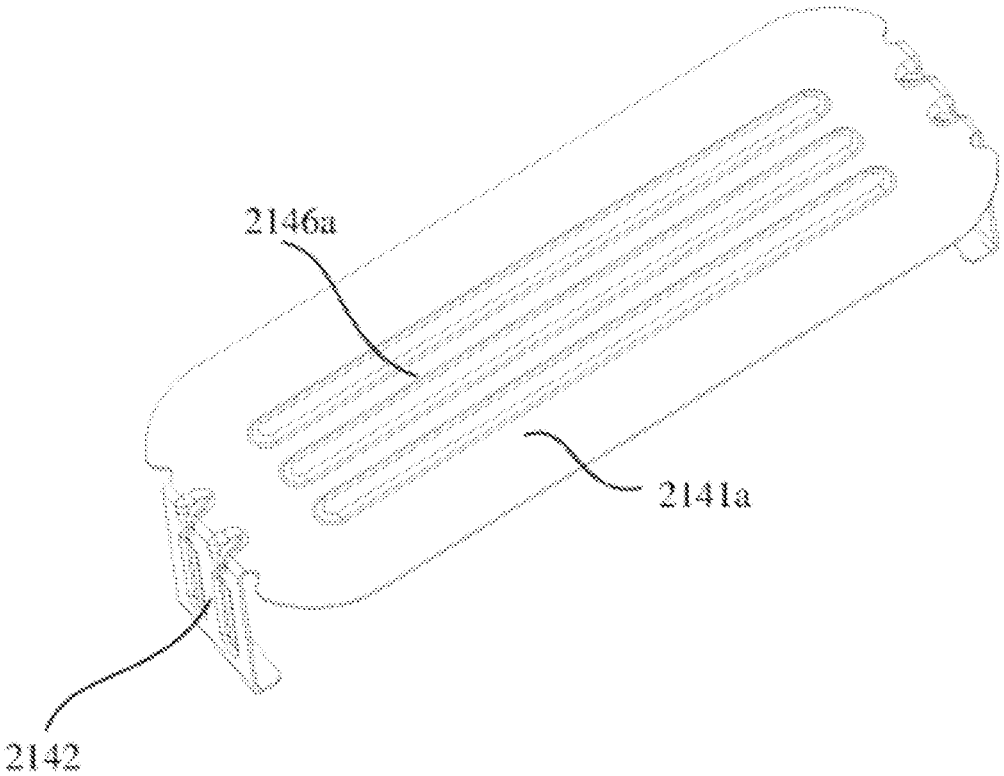
FIG. 15 is a back surface structure schematic diagram of a reinforcement portion body in the FIG. 10.

Further, with reference to FIG. 7, FIG. 9 and FIG. 14, the reinforcement portions (214*a*, 214*b*) comprise reinforcement portion bodies (2141*a*, 2141*b*, 2141*c*, 2141*d*), the reinforcement portion bodies (2141*a*, 2141*b*, 2141*c*, 2141*d*) being attached to the inner side surfaces (the sides, facing the magnetic circuit system 3), of the central portions 211, and the extension portions 2142 being formed by extending from the outer edges of the reinforcement portion bodies (2141*a*, 2141*b*, 2141*c*, 2141*d*).

In the embodiment, the extension portions 2142 are connected to the voice coil 12 and are driven by the voice coil 12 when the voice coil 12 works and vibrates, and transfer vibration to the second diaphragms (21*a*, 21*b*) to make the second diaphragms (21*a*, 21*b*) vibrate, and air in the second sound cavity 5 is compressed or dilated to produce sound. The extension portions 2142 are formed by extending from the outer edges of the reinforcement portion bodies (2141*a*, 2141*b*, 2141*c*, 2141*d*), so that mounting interference of the extension portions 2142 to the magnetic circuit system 3 can be reduced, thereby making arrangement more reasonable.

Figure 3:
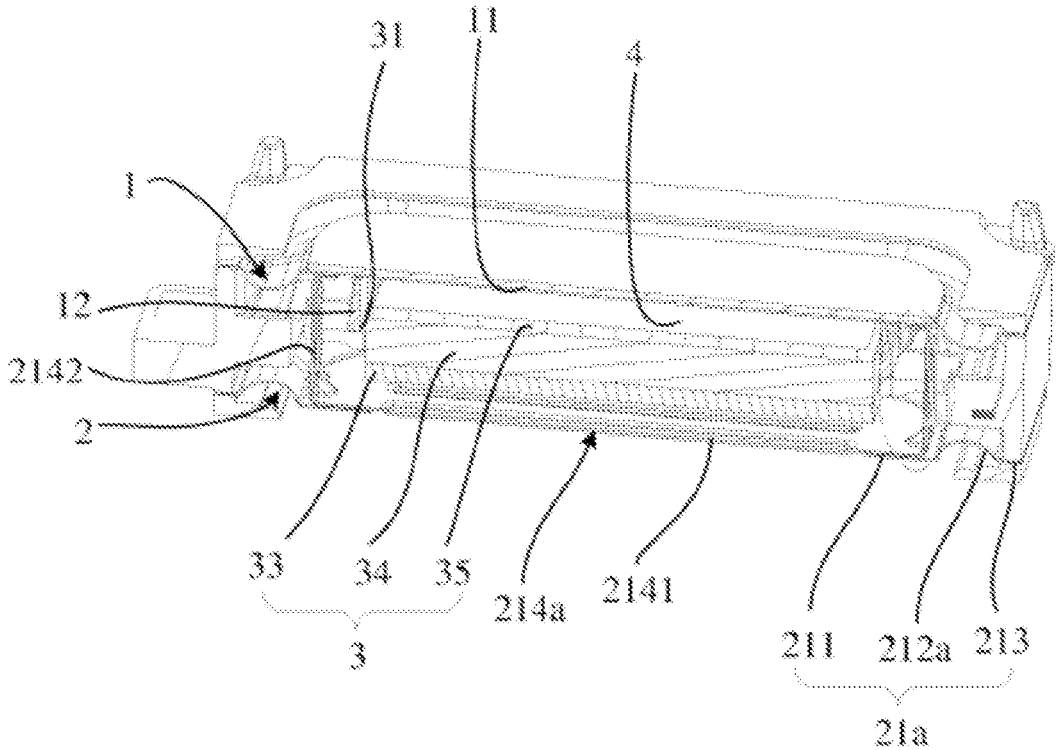
FIG. 3 is a sectional structural schematic diagram of a sound production apparatus in the FIG. 1, wherein a first embodiment of a second diaphragm is shown.
Figure 4:
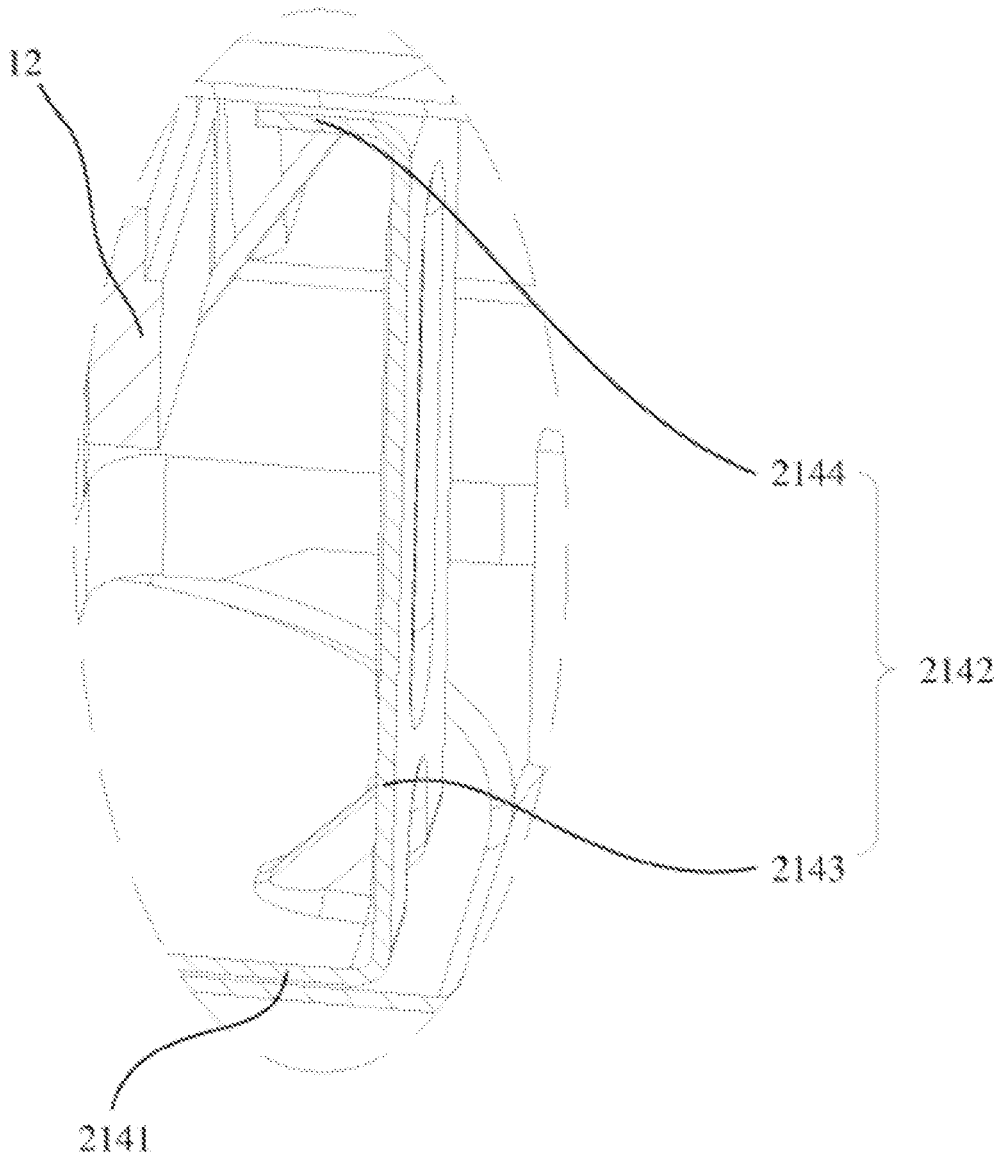
FIG. 4 is an amplified schematic diagram of a right end of a structure in the FIG. 3.
Figure 10:
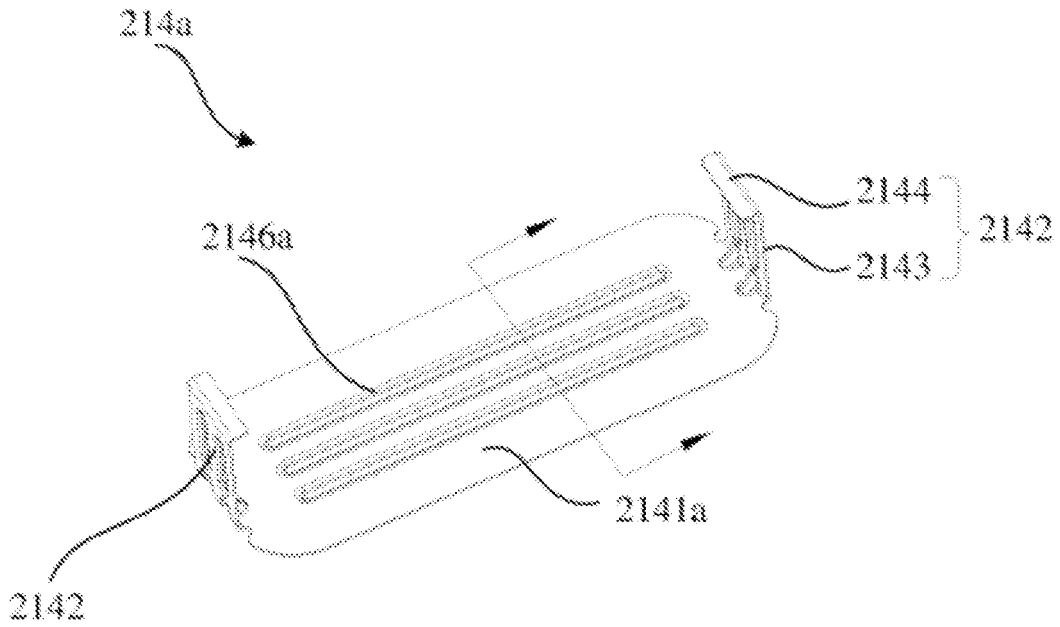
FIG. 10 is a front surface structure schematic diagram of a first embodiment of a reinforcement portion in the FIG. 9.
Figure 11:
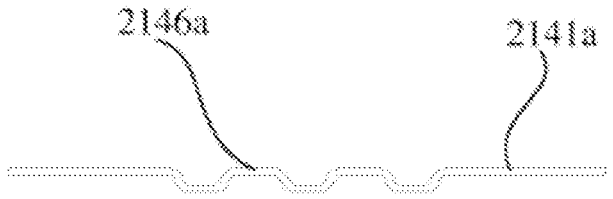
FIG. 11 is a sectional schematic diagram of a reinforcement portion body in the FIG. 10, wherein a first embodiment of the reinforcement portion bed is shown.

Preferably, with reference to FIG. 3, FIG. 4 and FIG. 10, reinforcing stiffeners extending along up-down directions are arranged on the extension portions 2142. Thus, the reinforcing stiffeners formed on the extension portions 2142 can strengthen the structural strength of the extension portions 2142.

Preferably, with reference to FIG. 3 and FIG. 4, extension portions 2142 are arranged outward in a protruding manner to form the reinforcing stiffeners. In this arrangement, interference of the reinforcing stiffeners on the extension portions 2142 to inner parts such as the magnetic circuit system 3 can be avoided.

Preferably, with reference to FIG. 10, a plurality of extension portions 2142 are arranged, the plurality of extension portions 2142 being disposed symmetrically about the center of the voice coil 12, such that it is convenient to either process and form the extension portions 2142 or mount and fix the reinforcement portion (214*a*, 214*b*).

Preferably, the extension portions 2142 are arranged on the periphery of the voice coil 12. Thus, interference of the extension portions 2142 to the mounting of the voice coil 12 or the magnetic circuit system 3 can be avoided.

Preferably, the reinforcement portion bodies (2141*a*, 2141*b*, 2141*c*, 2141*d*) and the extension portions 2142 are of an integrated structure.

In the arrangement, compared with the extension portions 2142 independently connected to the reinforcement portion bodies (2141*a*, 2141*b*, 2141*c*, 2141*d*), the reinforcement portion bodies (2141*a*, 2141*b*, 2141*c*, 2141*d*) and the extension portions 2142 are integrally formed, so that the process is simpler, batched production is facilitated, another working procedure of arranging independent connectors can be saved, and the product cost is reduced effectively. Thus, the reinforcement portions (214*a*, 214*b*) not only can have the function of the reinforcement portions of the second vibration system 2, but also can achieve the function of fixedly connecting the second vibration system 2 to the voice coil 12, so that the second diaphragms (21*a*, 21*b*) of the second vibration system 2 are driven by the voice coil 12 to vibrate to produce sounds during working.

Further, in the first embodiment of the present invention, with reference to FIG. 10 to FIG. 14, the reinforcement portion bodies (2141*a*, 2141*b*, 2141*c*, 2141*d*) are provided with a wavy reinforcing stiffener structure (2146*a*, 2146*b*, 2146*c*, 2146*d*) formed by at least one bump and at least one recess.

The reinforcement portion bodies (2141*a*, 2141*b*, 2141*c*, 2141*d*) are defined to have inner side surfaces facing the magnetic circuit system and outer side surfaces outwards. In the first embodiment of the present invention, as shown in the FIG. 11, the reinforcement portion body 2141*a* is provided with a wavy structure formed by a plurality of bumps and a plurality of recesses, wherein the highest part of the bump on the inner side is lower than the inner side surface of the reinforcement portion body 2141*a*, so that interference of the wavy reinforcement portion body 2141*a* to inner parts in the magnetic circuit system 3 and the like can be reduced.

Figure 12:
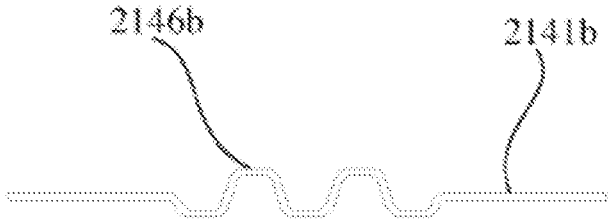
FIG. 12 is an another sectional schematic diagram of a reinforcement portion body in the FIG. 10, wherein a first embodiment of a reinforcement portion body is replaced by a second embodiment of the reinforcement portion body.

Surely, in the second embodiment of the present invention, as shown in the FIG. 12, the reinforcement portion body 2141*b* is provided with a wavy structure formed by a plurality of bumps and a plurality of recesses, wherein the highest part of the bump on the inner side is higher than the inner side surface of the reinforcement portion body 2141*a*.

Figure 13:
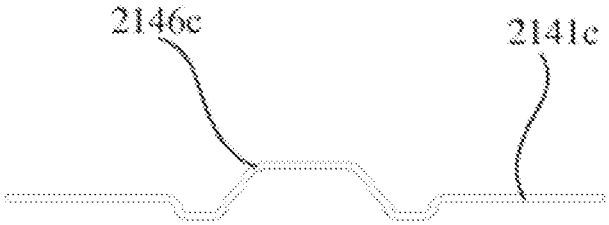
FIG. 13 is yet another sectional schematic diagram of a reinforcement portion body in the FIG. 10, wherein a first embodiment of the reinforcement portion body is replaced by a third embodiment of the reinforcement portion body.

In the third embodiment of the present invention, as shown in the FIG. 13, the reinforcement portion body 2141*c* is provided with a wavy structure formed by one bump and two recesses.

Surely, in the fourth embodiment of the present invention, as shown in the FIG. 14, the reinforcement portion body 2141*d* can be further arranged as a reinforcement portion body formed by one bump.

Figure 5:
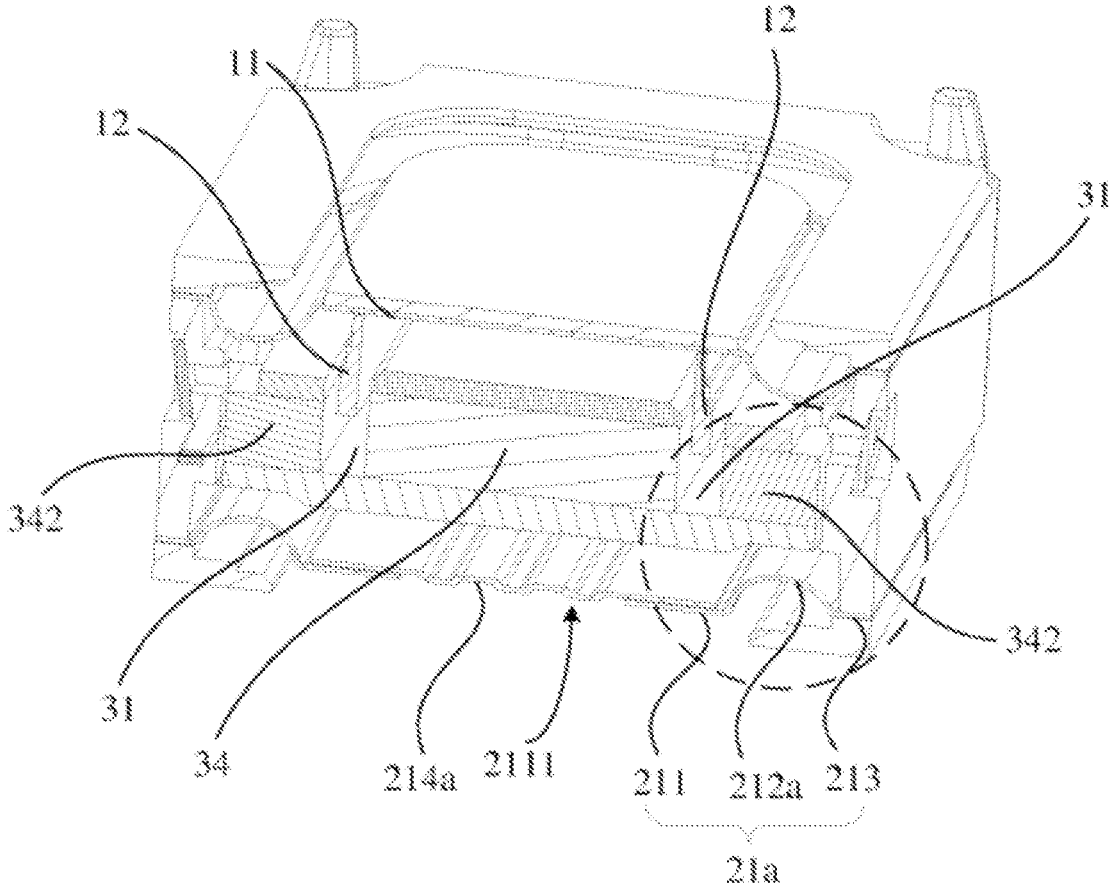
FIG. 5 is an another sectional structural schematic diagram of a sound production apparatus in the FIG. 1, wherein a first embodiment of a second diaphragm is shown.

Further, with reference to FIG. 3, FIG. 5 and FIG. 7, the reinforcement portion 214*a* is combined to the inner side of the central portion 211, the central portion 211 is of a planar sheet structure, the central portion 211 is provided with material removal holes 2111, and the bumps of the wavy reinforcing stiffener structures (2146*a*, 2146*b*, 2146*c*, 2146*d*) are located in the material removal holes 2111.

In particular, as shown in the FIG. 4 and FIG. 5, the second diaphragms (21*a*, 21*b*) further comprise corrugated rim portions (212*a*, 212*b*) arranged around the central portions 211 and fixation portions 213 arranged around the corrugated rim portions (212*a*, 212*b*).

In the application, the central portions 211 are provided with the material removal holes 2111 to yield the bumps of the wavy reinforcement bodies (2141*a*, 2141*b*, 2141*c*, 2141*d*) so as to prevent interference to mounting of the wavy reinforcement bodies (2141*a*, 2141*b*, 2141*c*, 2141*d*). The central portions 211 are used for sensing density change of air in the second sound cavity 5 and vibrating with it to produce sounds, i.e. producing sounds passively radiately. By arranging the central portions 211 as the planar sheet structure, the second diaphragms (21*a*, 21*b*) occupy relatively small spaces in the up-down direction and can produce enough large vibrating amplitude. The corrugated rim portions (212*a*, 212*b*) provide certain smoothness (that is, provide certain flexibility) to the movement of the central portions 211, so that the central portions 211 are prone to be pushed to vibrate to produce sounds.

Surely, in the first embodiment of the present invention, as shown in the FIG. 5, the corrugated rim portion 212*a* is of a structure formed by one bump.

Figure 6:
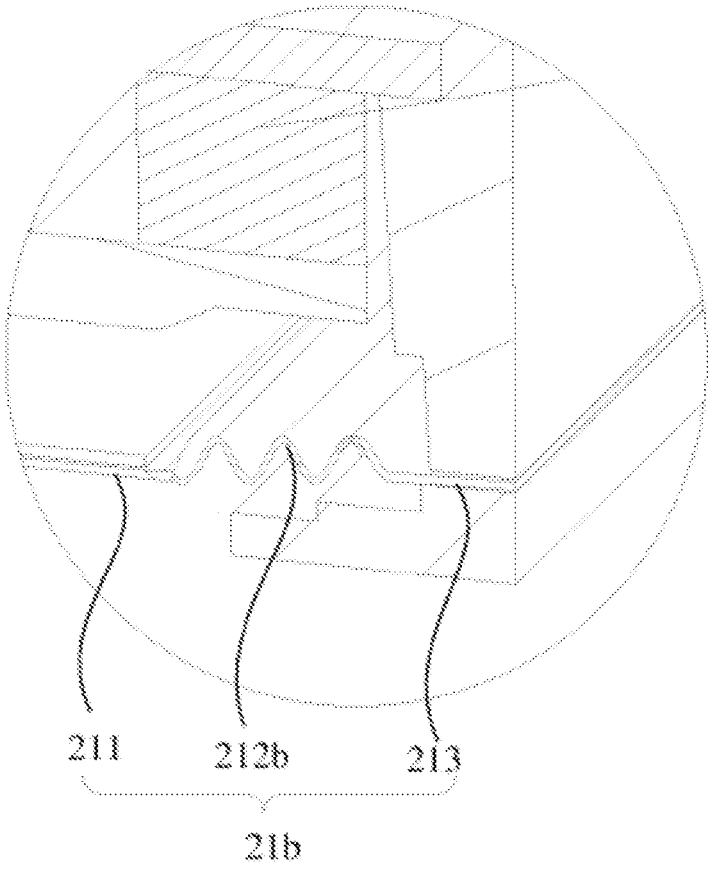
FIG. 6 is an amplified schematic diagram of a structure in the FIG. 5, wherein a first embodiment of a second diaphragm is replaced by a second embodiment of the second diaphragm.

In the second embodiment of the present invention, as shown in the FIG. 6, the corrugated rim portion 212*b* is of a wavy structure formed by at least one bump and at least one recess, that is, the corrugated rim portion 212*b* comprises a plurality of corrugated rim structures, and any adjacent two corrugated rim structures are arranged oppositely in depression direction.

Figure 25:
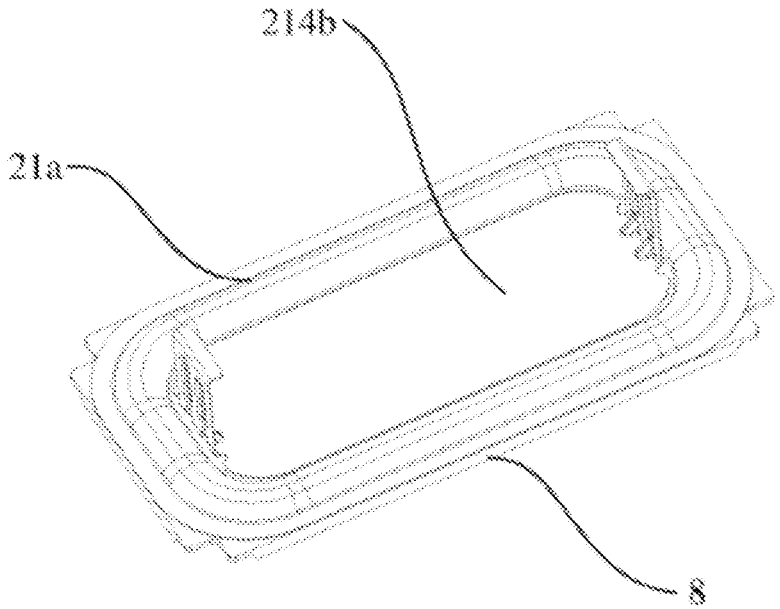
FIG. 25 is a front surface structure schematic diagram of a sixth embodiment of a reinforcement portion of a sound production apparatus of the present invention.
Figure 26:
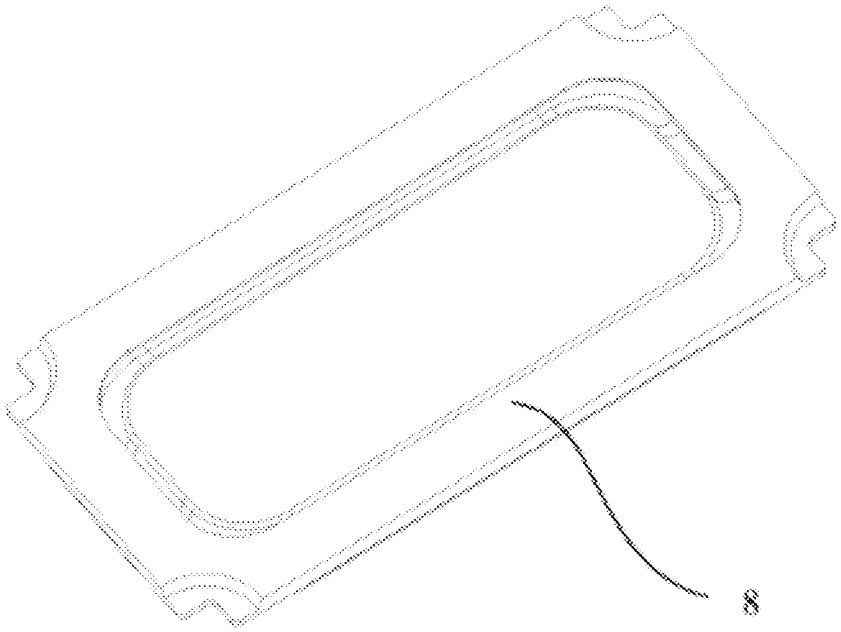
FIG. 26 is a back surface structure schematic diagram of a sixth embodiment of a reinforcement portion of a sound production apparatus of the present invention.

As a structural design of another reinforcement portion 214*b*, in the fifth embodiment of the present invention, as shown in the FIG. 25 and FIG. 26, the central portion 211 is of the planar sheet structure, and the central portion 211 is not provided with a hole and is not hollowed out. The reinforcement portion body of the reinforcement portion 214*b* is not provided with a reinforcing stiffener, and the reinforcement portion body is in attached connection to the central portion 211.

With reference to FIG. 7, the second diaphragms (21*a*, 21*b*) are rectangular, and the reinforcing stiffener structures (2146*a*, 2146*b*, 2146*c*, 2146*d*) extend along the length directions of the second diaphragms (21*a*, 21*b*).

In particular, on a premise of same area, the rectangular second diaphragms (21*a*, 21*b*) are prone to obtain large vibrating amplitudes, and the reinforcement portion bodies (2141*a*, 2141*b*, 2141*c*, 2141*d*) are arranged stripe-like and extend along the length directions of the second diaphragms (21*a*, 21*b*) so as to be matched with the second diaphragms (21*a*, 21*b*) better.

Further, the reinforcement portions (214*a*, 214*b*) are combined to the inner sides of the central portions 211, the extension portion 2142 is provided with the reinforcing rib 2148 on at least one of two opposite side edges in the circumferential direction of the reinforcement portion bodies (2141*a*, 2141*b*, 2141*c*, 2141*d*), and the reinforcing rib 2148 is fixedly connected to the reinforcement portion bodies (2141*a*, 2141*b*, 2141*c*, 2141*d*).

Thus, the reinforcing rib 2148 can play a role of reinforcing structural strength of the extension portion 2142. Surely, in specific applications, the reinforcing rib 2148 can be arranged in a straight plate structure or an arc-shaped structure and etc.

Figure 16:
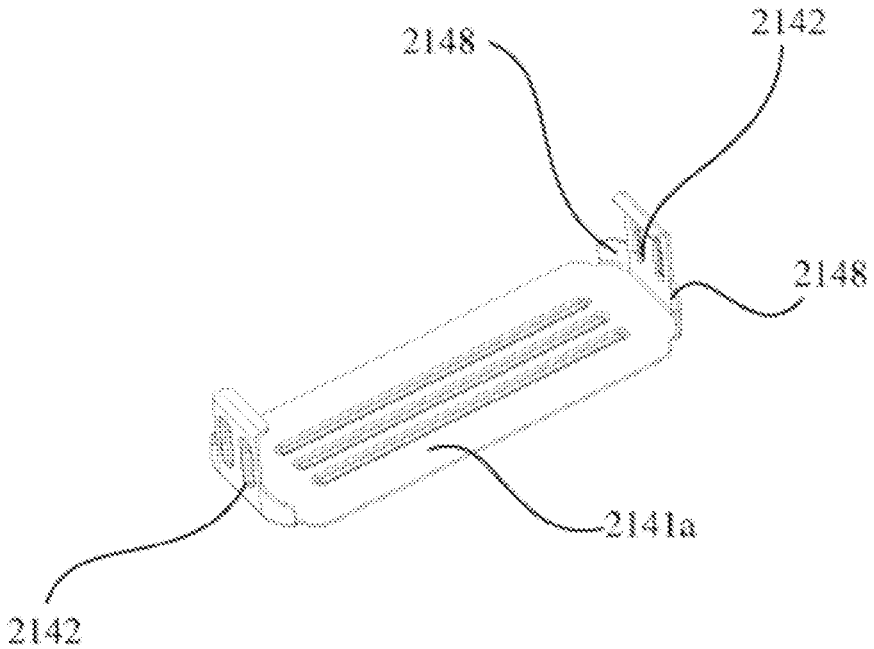
FIG. 16 is a front surface structure schematic diagram of a second embodiment of a reinforcement portion in the FIG. 1.

In the second embodiment of the present invention, as shown in the FIG. 16, the extension portion 2142 is provided with the reinforcing ribs 2148 separately on two opposite side edges in the circumferential direction of the reinforcement portion bodies (2141*a*, 2141*b*, 2141*c*, 2141*d*). Thus, a better effect of reinforcing the structural strength of the extension portion 2142 can be achieved.

Figure 17:
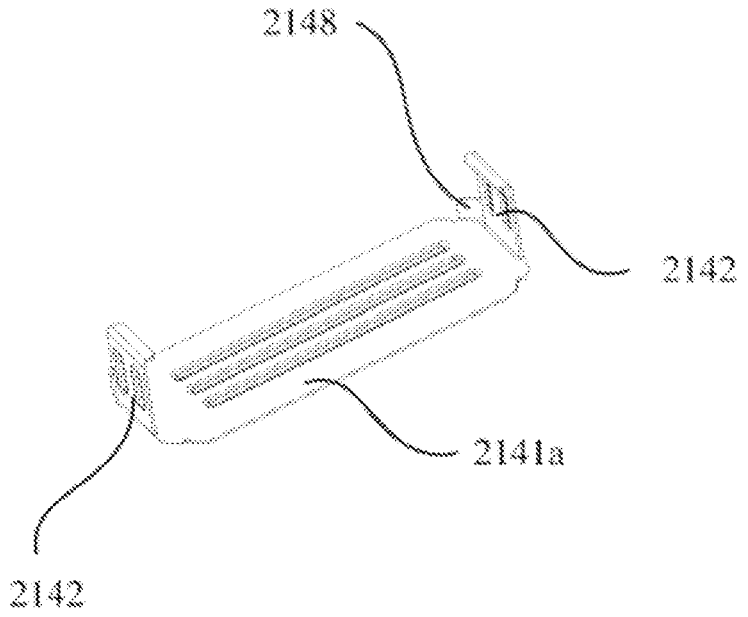
FIG. 17 is a front surface structure schematic diagram of a third embodiment of a reinforcement portion in the FIG. 1.

Surely, in the third embodiment of the present invention, as shown in the FIG. 17, the extension portion 2142 is provided with the reinforcing rib 2148 on one of two opposite side edges in the circumferential direction of the reinforcement portion bodies (2141*a*, 2141*b*, 2141*c*, 2141*d*).

Further, the extension portion 2142 comprises a main body portion 2143 extending upward from the reinforcement portion bodies (2141*a*, 2141*b*, 2141*c*, 2141*d*) and a first folding portion 2144, the first folding portion 2144 is formed by being folded inwardly from an upper edge of the main body portion 2143, and the first folding portion 2144 is attached to the first diaphragm 11 and fixedly connected to the first diaphragm 11.

In the first embodiment of the present invention, as shown in the FIG. 10, the extension portion 2142 is only provided with the main body portion 2143 and the first folding portion 2144 and is attached to the first diaphragm 11 through the first folding portion 2144 and is fixedly connected to the diaphragm 11, thus, after the first diaphragm 11 is driven by the voice coil 12 to vibrate during working, the first diaphragm 11 can transfer vibration to the second diaphragms (21*a*, 21*b*) through the first folding portion 2144, the main body portion 2143 and the reinforcement portion bodies (2141*a*, 2141*b*, 2141*c*, 2141*d*) and drives the second diaphragms (21*a*, 21*b*) synchronously to vibrate to produce sounds. The arrangement of the first folding portion 2144 facilitates the mounting and connection with the first diaphragm 11.

Further, the extension portion 2142 further comprises a second folding portion 2145 formed by being folded outwardly from an upper edge of the main body portion 2143, and the second folding portion 2145 is attached to the first diaphragm 11 and is fixedly connected to the first diaphragm 11.

Figure 18:
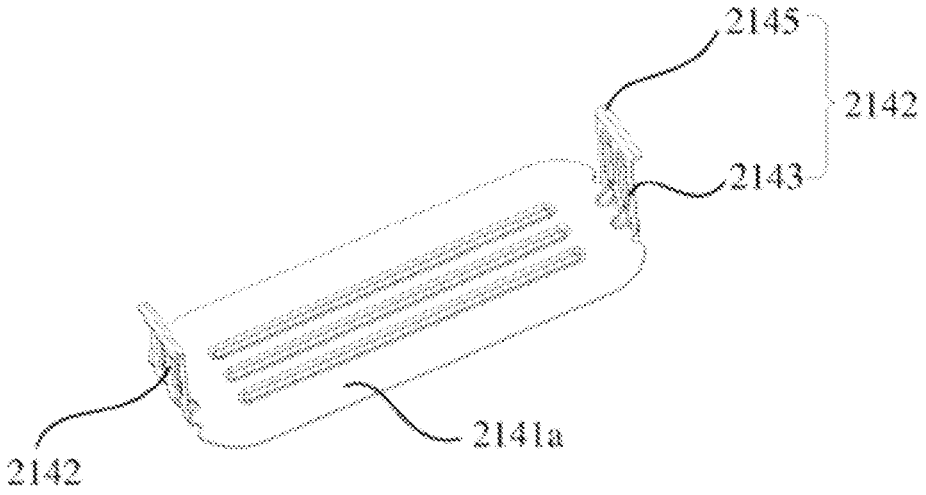
FIG. 18 is a front surface structure schematic diagram of a fourth embodiment of a reinforcement portion in the FIG. 1.

In the fourth embodiment of the present invention, as shown in the FIG. 18, as a structural design of another folding connection, the extension portion 2142 is only provided with the main body portion 2143 and the second folding portion 2145 and is attached to the first diaphragm 11 through the second folding portion 2145 and is fixedly connected to the diaphragm 11, thus, after the first diaphragm 11 is driven by the voice coil 12 to vibrate during working, the first diaphragm 11 can transfer vibration to the second diaphragms (21*a*, 21*b*) through the second folding portion 2145, the main body portion 2143 and the reinforcement portion bodies (2141*a*, 2141*b*, 2141*c*, 2141*d*) and drives the second diaphragms (21*a*, 21*b*) synchronously to vibrate to produce sounds. The arrangement of the second folding portion 2145 facilitates the mounting and connection with the first diaphragm 11.

Figure 19:
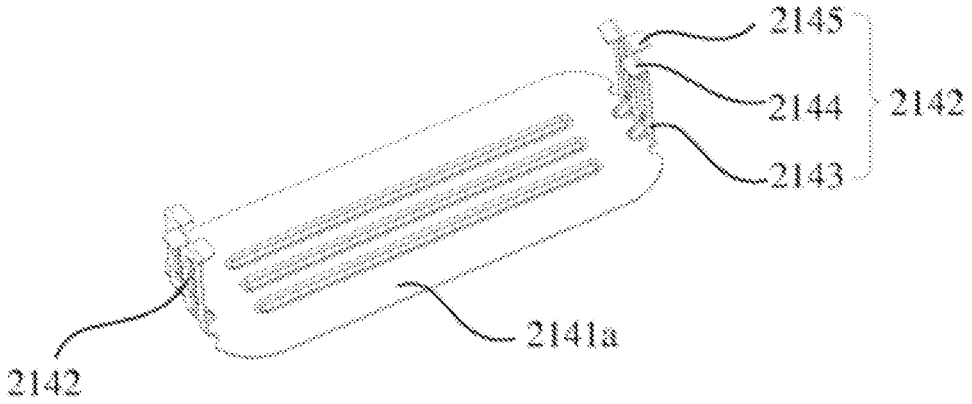
FIG. 19 is a front surface structure schematic diagram of a fifth embodiment of a reinforcement portion in the FIG. 1.
Figure 20:
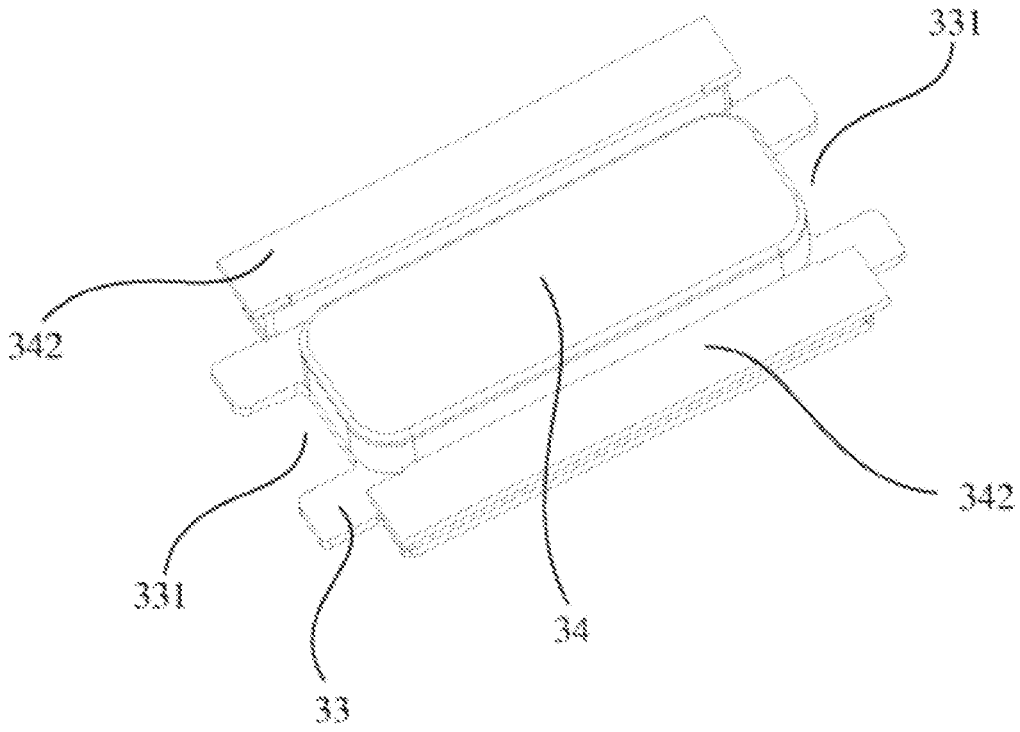
FIG. 20 is a front surface structure schematic diagram of a magnetic circuit system in the FIG. 1.

Surely, in the fifth embodiment of the present invention, as shown in the FIG. 19, as a structural design of another folding connection, the extension portion 2142 is provided with the main body portion 2143, at least one first folding portion 2144 and at least one second folding portion 2145 simultaneously, thus, it is convenient to connect the extension portion 2142 to the first diaphragm 11 by means of the first folding portion 2144 and the second folding portion 2145.

Further, with reference to the FIG. 3, FIG. 5, FIG. 9 and FIG. 10, the magnetic circuit system 3 further comprises a central magnetic circuit portion and a side magnetic circuit portion arranged on a magnetic conductive yoke 33, the central magnetic circuit portion comprising stripe-type central magnetic steel 34; the side magnetic circuit portion comprises two side magnetic steels 342, the two side magnetic steels 342 being separately arranged on two long side edges of the central magnetic steel 34; two extension portions 2142 are provided, the two extension portions 2142 being arranged separately corresponding to the outer sides of two ends of the central magnetic steel 34, that is, being arranged corresponding to the outer side of the voice coil.

In particular, with reference to the FIG. 3 and FIG. 5, the central magnetic steel 34 is arranged at the bottom of the magnetic conductive yoke 33, a magnetic conductive plate 35 is further arranged on the top of the central magnetic steel 34, and a magnetic gap 31 for accommodating the voice coil 12 is formed between the central magnetic steel 34 and the side magnetic steel 342; and at least one of the central magnetic circuit portion and the side magnetic circuit portion is provided with a permanent magnet. Surely, the magnetic circuit system in the application can be arranged as either a single magnetic circuit system or a tri-magnetic circuit system and the like. Preferably, as shown in the FIG. 3 and FIG. 7, the first diaphragm 11, the second diaphragms (21*a*, 21*b*) and the central magnetic steel 34 are stripe-like, and long shafts of the first diaphragm 11, the second diaphragms (21*a*, 21*b*) and the central magnetic steel 34 are located in a same vertical plane.

Optionally, with reference to the FIG. 3, FIG. 5, FIG. 9 and FIG. 10, the magnetic conductive yoke 33 is of the rectangular plate structure, the two side magnetic steel 342 are arranged on two long side edges of the magnetic conductive yoke 33, and the extension portion 2142 passes through the avoidance portion 331 located on the short side edge of the magnetic conductive yoke 33 (in the embodiment, the avoidance portion is the avoidance notch formed in the short side edge of the magnetic conductive yoke 33); or the magnetic conductive yoke 33 is of the rectangular plate structure, the two side magnetic steels are also arranged on two short side edges of the magnetic conductive yoke 33, and the extension portion 2142 passes through the avoidance portion located on the long side edge of the magnetic conductive yoke 33 (similarly, the avoidance portion can be the avoidance notch formed in the short side edge of the magnetic conductive yoke 33).

The above is introduction by taking the rectangular sound production apparatus as an example. It is easy to understand that the technical solutions can be further suitable for a round sound production apparatus. At such time, the magnetic circuit system is arranged in a circular ring shape, and correspondingly, the first and second diaphragms are, also arranged in circular ring shapes.

In the embodiment, it can be understood that the vertical plane is a plane parallel to the up-down direction. As the first diaphragm 11 and the second diaphragms (21*a*, 21*b*) are rectangular, the central magnetic steel 34 is further arranged in the rectangular stripe shape. Correspondingly, the sound production apparatus 210 is rectangular, too. Compared with the round shape, the structure has higher spatial utilization ratio when being applied to the portable terminal 100. Meanwhile, on the premise of same area, the first diaphragm 11 and the second diaphragms (21*a*, 21*b*) in the stripe shape are prone to obtain larger vibrating amplitudes.

Figure 21:
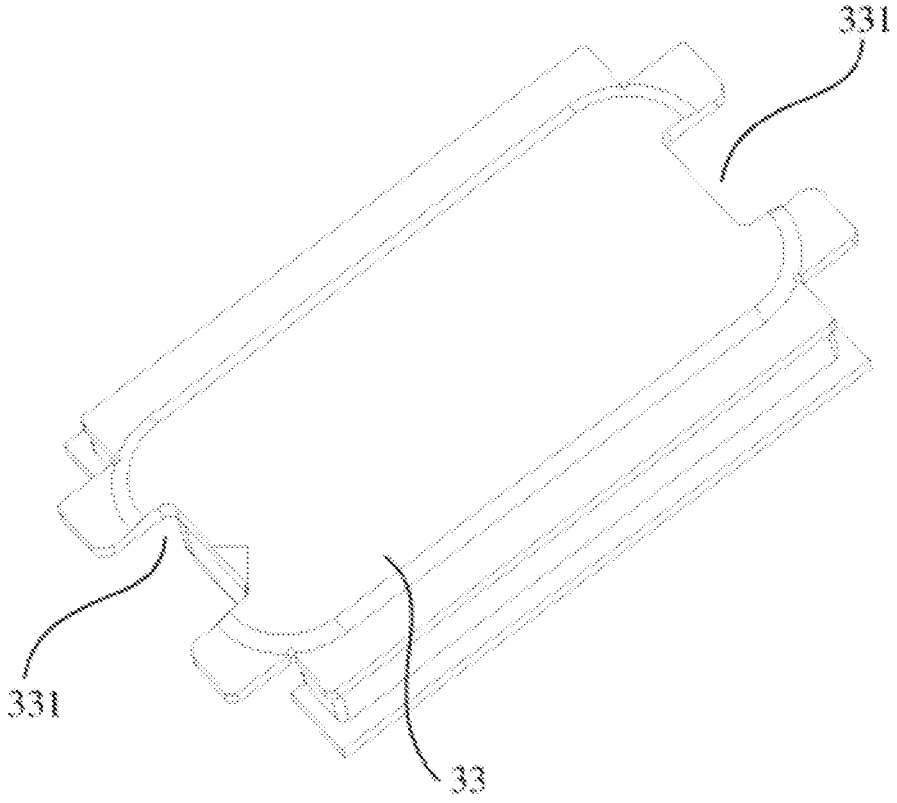
FIG. 21 is a back surface structure schematic diagram of a magnetic circuit system in the FIG. 1.
Figure 22:
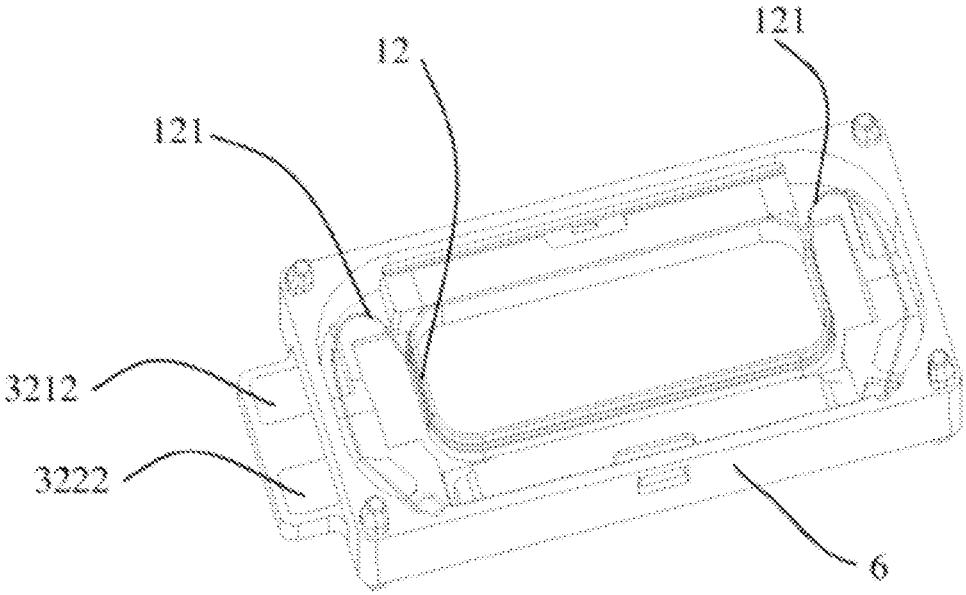
FIG. 22 is a structural schematic diagram of connection of a first electric connector, a second electric connector and a voice coil of a sound production apparatus shown in the FIG. 1.
Figure 23:
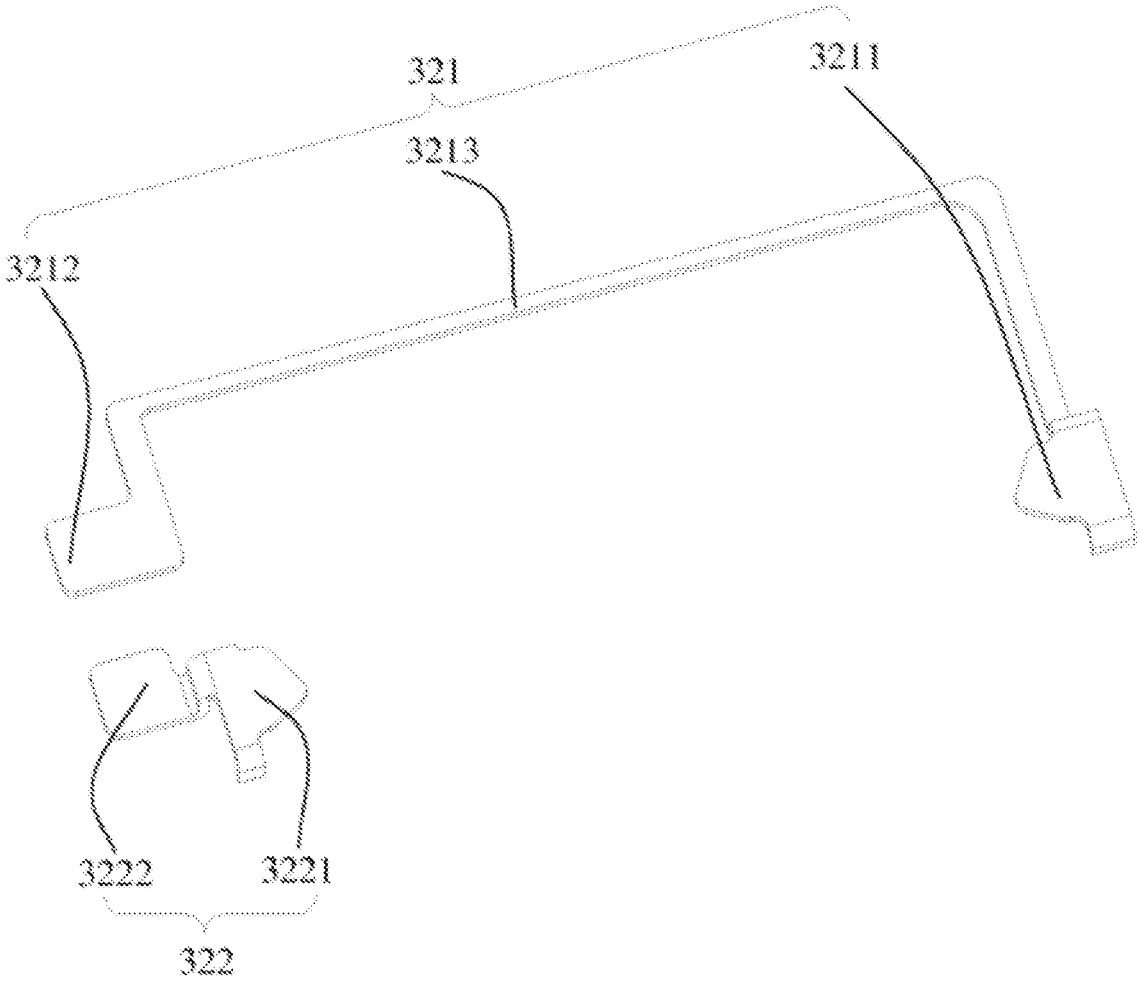
FIG. 23 is a structural schematic diagram of a first electric connector and a second electric connector as shown in the FIG. 22.

Further, with reference to the FIG. 21 and FIG. 22, the sound production apparatus 210 further comprises a first electric connector 321 and a second electric connector 322, wherein the first electric connector 321 comprises a first internal bonding pad 3211 and a first external bonding pad 3212, a half-surrounded voice coil 12 and a connecting portion 3213 that connect the first internal bonding pad 3211 and the first external bonding pad 3212;

the second electric connector 322 comprises a second internal bonding pad 3221 and a second external bonding pad 3222 connected to each other; and two leading wires of the voice coil 12 are electrically connected to the first internal bonding pad 3211 and the second internal bonding pad 3221, separately;

and the first internal bonding pad 3211 is close to one short edge of the central magnetic steel 34, and the second internal bonding pad 3221, the first external bonding pad 3212 and the second external bonding pad 3222 are all close to the other short edge of the central magnetic steel 34.

In the embodiment, by designing the half-surrounded structure of the connecting portion 3213, the first internal bonding pad 3211 and the first external bonding pad 3212 are arranged at the short edge close to the central magnetic steel 34, i.e. the bonding pad in the prior art distributed on one side of the long edge of a product is transferred to one side of the short edge of the product by the L-shaped connecting portion 3213. The first internal bonding pad 3211, the first external bonding pad 3212 and the connecting portion 3213 can be arranged in an integrally formed structure, so that processing and forming are facilitated and the mounting steps are reduced. Furthermore, the second internal bonding pad 3221 and the second external bonding pad 3222 are also arranged on the short edge close to the central magnetic steel 34, thus, the leading wire 121 of the voice coil 12 is extracted from the short edge of the voice coil and is connected to the first internal bonding pad 3211 and the second internal bonding pad 3221, separately, so that it can be ensured that problems of disconnecting risk and noise of the leading wire of the product during work are avoided. The second internal bonding pad 3221 and the second external bonding pad 3222 can be arranged in an integrally formed structure, so that processing and forming are facilitated and the mounting steps are reduced. As shown in the FIG. 21, the first external bonding pad 3212 and the second external bonding pad 3222 extend out of a single shape of the sound production apparatus, so that on the one hand, the effective radiating areas of the first vibration system 1 and the second vibration system 2 can be kept consistent so as to guarantee a consistency of acoustic performances of the first vibration system 1 and the second vibration system 2, and on the other hand, the effective radiating areas of the first diaphragm 11 and the second diaphragm (21*a*, 21*b*) can be maximized to obtain the optimum acoustic performance, so that the sound production apparatus obtains the optimum acoustic performance favorably when applied to the terminal.

In the embodiment, the housing 6 is arranged rectangular, the short shaft side of the housing 6 is provided with a protrusion portion protruding out of the housing 6, and the first external bonding pad 3212 and the second external bonding pad 3222 are located on the protrusion portion.

Surely, the technical solutions can be also applied to the round sound production apparatus, and at such time, the housing is arranged in an annular shape, the side surface of the housing is provided with a protrusion portion protruding out of the housing, and the first and second external bonding pads are located on the protrusion portion as well.

Further, the first diaphragm 11 comprises a central portion, a corrugated rim portion arranged around the central portion and a fixation portion arranged around the corrugated rim portion, and the central portion of the first diaphragm 11 is of a planar sheet structure. Similarly, by arranging the central portion of the first diaphragm 11 as the planar sheet structure, the first diaphragm 11 occupies smaller space in the up-down direction and can generate large enough vibrating amplitude. In combination with the embodiment where the central portions of the second diaphragms (21*a*, 21*b*) are arranged as the sheet structure, the sound production apparatus provided by the present invention forms a relatively thin structure in the up-down direction, so that the sound production apparatus is prone to be applied to a flat mounting space.

Figure 24:
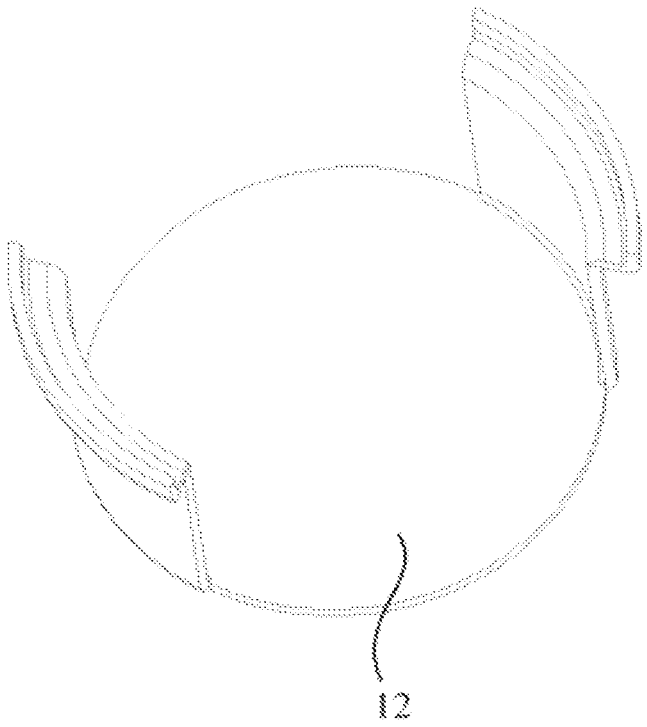
FIG. 24 is a structural schematic diagram of a first embodiment of a voice coil of a sound production apparatus in the FIG. 3.

Further, the voice coil 12 can be designed in the round shape as shown in the FIG. 24 (for example, when applied to the round sound production apparatus), or can be designed in other shapes such as square, runway and ellipse as needed.

Figure 27:
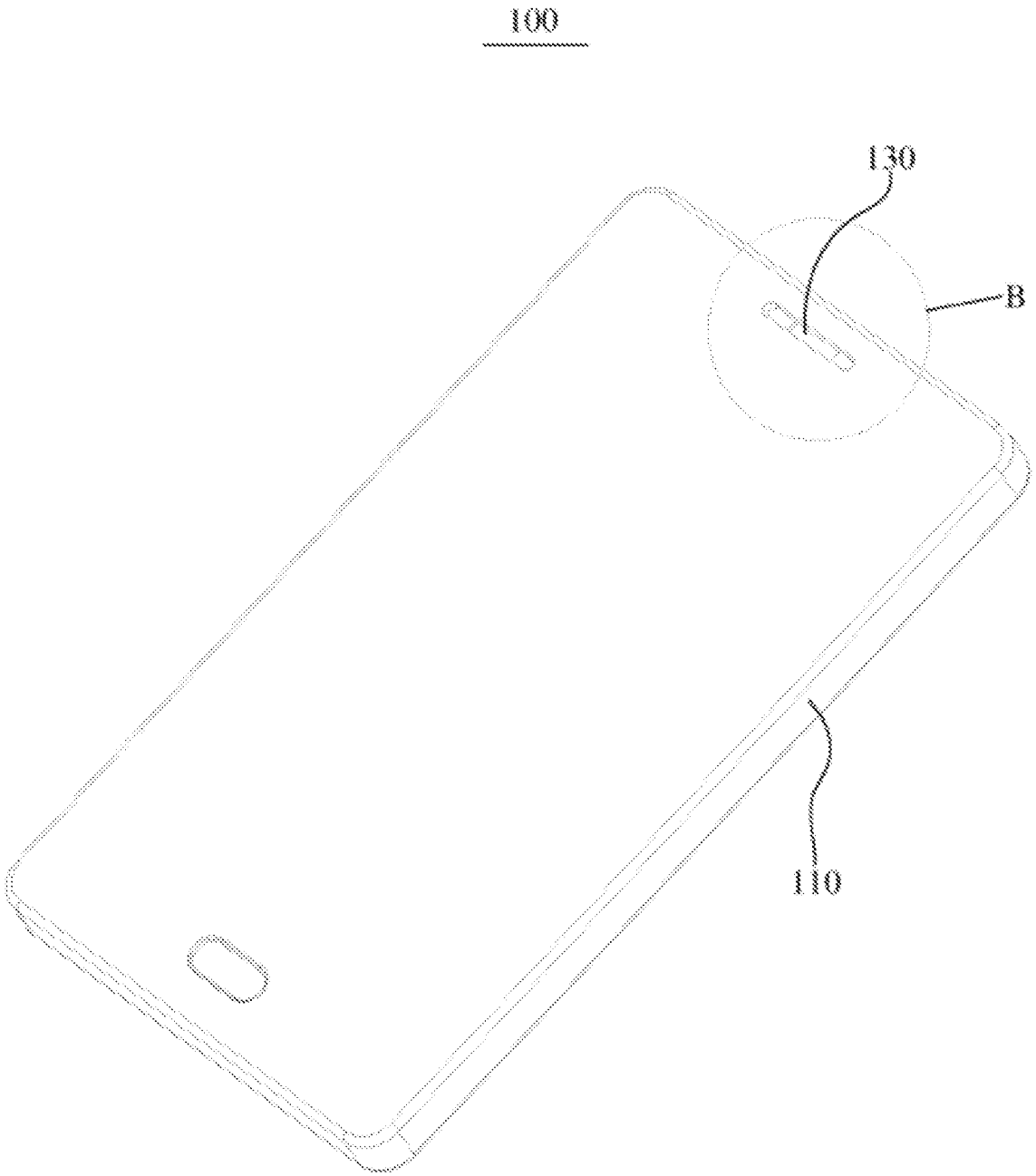
FIG. 27 is a front surface structure schematic diagram of an embodiment of a portable terminal of the present invention.
Figure 28:
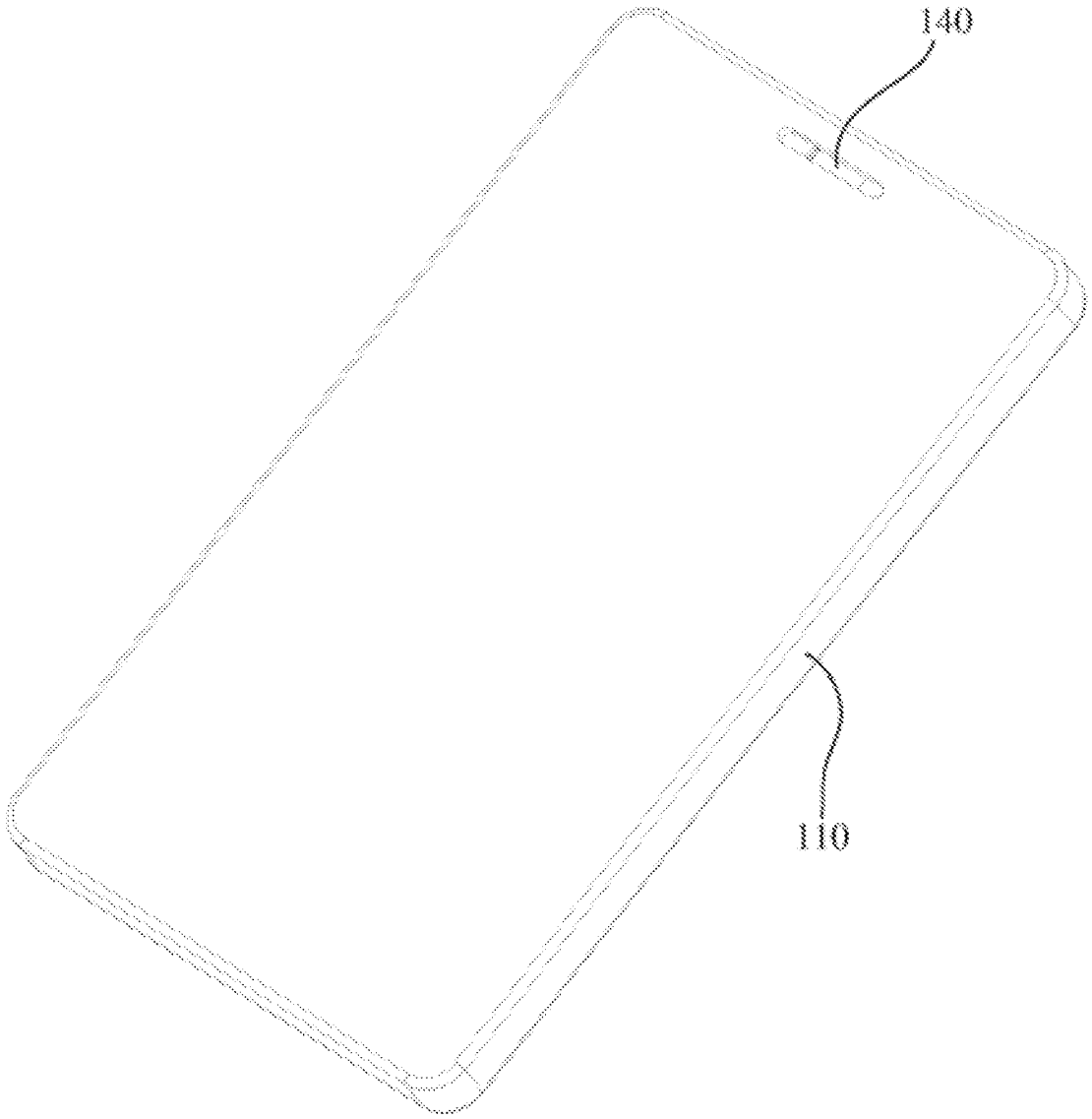
FIG. 28 is a back surface structure schematic diagram of a portable terminal in the FIG. 27.
Figure 29:
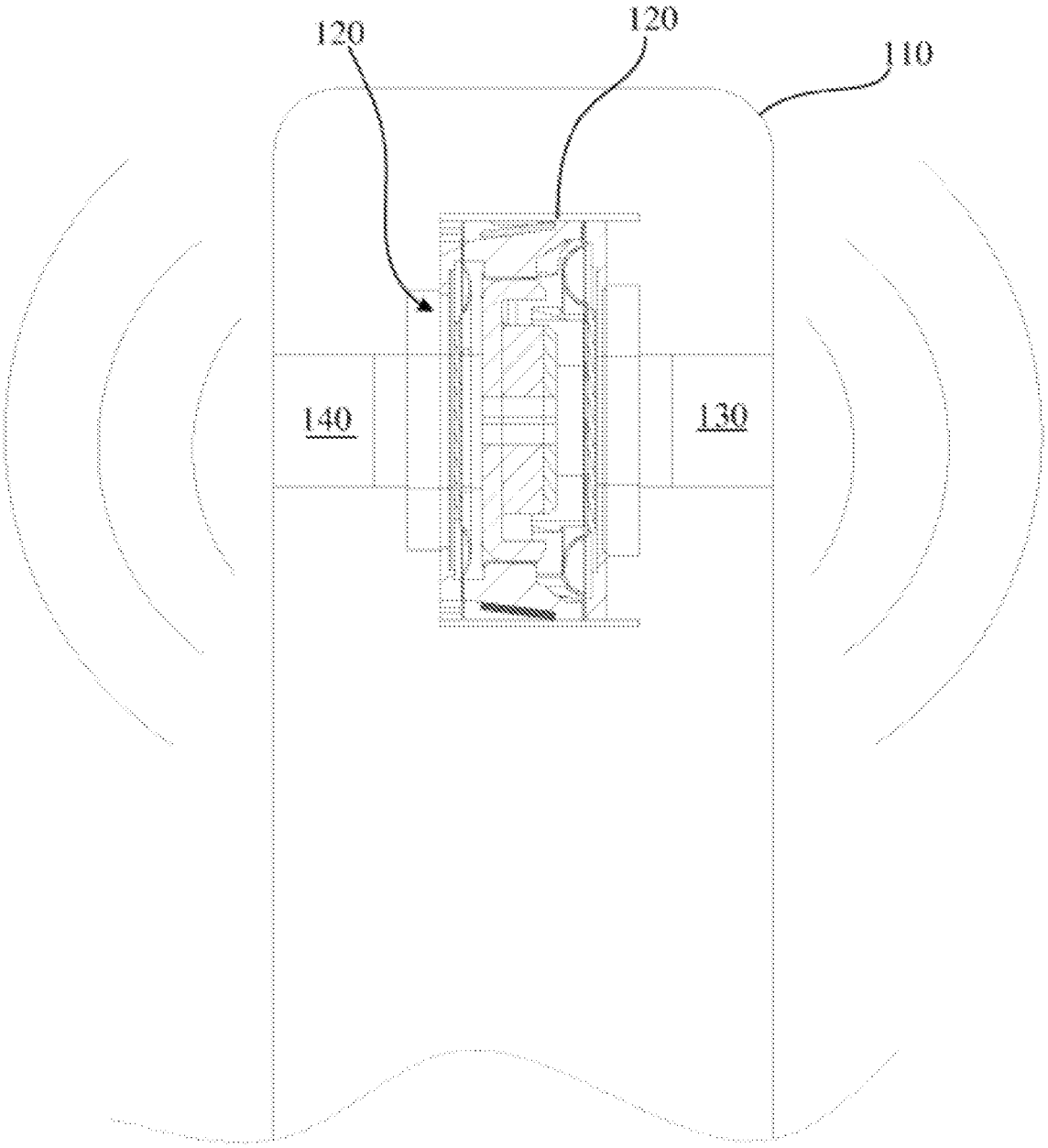
FIG. 29 is a local sectional structural schematic diagram of B in the FIG. 27.

The invention further provides a portable terminal 100. With reference to the FIG. 27 to FIG. 29, the portable terminal 100 comprises a housing 110. The housing 110 has an accommodation cavity 120 inside. The portable terminal 100 further comprises the sound production apparatus 210. Reference of the specific structure of the sound production apparatus 210 is made to the embodiments. As the portable terminal 100 adopts all technical solutions of all the above embodiments, the portable terminal 100 at least has all beneficial effects brought by the technical solutions of the above embodiments, which is not elaborated herein. The sound production apparatus 210 is mounted in the accommodation cavity 120, the housing 110 is provided with a first sound hole 130 corresponding to the first diaphragm 11 and a second sound hole 140 corresponding to the second diaphragm (21*a*, 21*b*). Preferably, in order to shorten the propagation path of sound in the housing 110 and reduce acoustic resistance, the first sound hole 130 is formed in a position, directly facing the first diaphragm 11, of the housing 110, and the second sound hole 140 is formed in a position, directly facing the second diaphragm (21*a*, 21*b*), of the housing 110.

Further, the housing 110 of the portable terminal 100 is provided with a front surface and a back surface arranged oppositely, wherein the first sound hole 130 is formed in the front surface and the second sound hole 140 is formed in the back surface, thereby achieving bidirectional synchronous sound production.

The above are only preferred embodiments of the present invention and are not intended to limit the scope of present invention. Under the same inventive concept, any equivalent structure modification used according to the contents of the specifications and drawings in the present invention, no matter whether it is directly or indirectly used in any other related technical field, should be included within the protection scope of the present invention.

The invention claimed is:

1. A sound production apparatus, comprising a first vibration system, a second vibration system and a magnetic circuit system, wherein the first vibration system comprises a first diaphragm and a voice coil arranged on a first side, facing the magnetic circuit system, of the first diaphragm;

the second vibration system comprises a second diaphragm arranged opposite to the first diaphragm, and wherein the apparatus is adapted such that:

a middle position of the second diaphragm is combined with a reinforcement portion;

the reinforcement portion is provided with an extension portion extending along a direction proximate to the first diaphragm, and a position, corresponding to the extension portion, in the magnetic circuit system is provided with an avoidance portion; wherein the extension portion is adapted for passing through the avoidance portion, and is fixed to the first diaphragm, wherein the second diaphragm comprises a central portion located in the middle position, a corrugated rim portion located on an outer side of the central portion and a fixation portion integrally provided with the corrugated rim portion; and the reinforcement portion comprises a reinforcement portion body, the reinforcement portion body attached to the central portion and the extension portion formed by extending from an outer edge of the reinforcement portion body, wherein the extension portion is provided with a reinforcing stiffener extending in an up-down direction.

2. The sound production apparatus according to claim 1, wherein the reinforcement portion is combined to a side, facing the magnetic circuit system, of the central portion, and the extension portion movably passes through the avoidance portion to be extended fixed to the first diaphragm; or the reinforcement portion is combined to a side, distal from the magnetic circuit system, of the central portion, the second diaphragm is further provided with a mounting hole where the extension portion passes through, and the extension portion movably passes through the avoidance portion to be extended fixed to the first diaphragm.

3. The sound production apparatus according to claim 1, wherein the reinforcement portion body is provided with a wavy reinforcing stiffener structure formed by at least one hump and at least one recess.

4. The sound production apparatus according to claim 3, wherein the central portion is of a planar sheet structure and provided with a material removal hole, and the bump of the wavy reinforcing stiffener structure is accommodated in the material removal hole.

5. The sound production apparatus according to claim 3, wherein the second diaphragm is rectangular, and the reinforcing stiffener structure is arranged to extend along a length direction of the second diaphragm.

6. The sound production apparatus according to claim 1, wherein the extension portion is provided with a reinforcing rib on at least one of two opposite side portions in a circumferential direction of the reinforcement portion body, and the reinforcing rib is fixedly connected to the reinforcement portion body.

7. The sound production apparatus according to claim 1, wherein the extension portion comprises a main body portion extending upward from the reinforcement portion body and a first folding portion, the first folding portion is formed by being folded inwardly from an upper edge of the main body portion, and the first folding portion is attached to the first diaphragm and fixedly connected to the first diaphragm.

8. The sound production apparatus according to claim 1, wherein the extension portion further comprises a second folding portion formed by being folded outwardly from an upper edge of the main body portion, and the second folding portion is attached to the first diaphragm and is fixedly connected to the first diaphragm.

9. The sound production apparatus according to claim 1, wherein the corrugated rim portion of the second diaphragm comprises a plurality of corrugated rim structures, and any adjacent two corrugated rim structures have opposite depression directions.

10. The sound production apparatus according to claim 1, wherein the magnetic circuit system further comprises a central magnetic circuit portion and a side magnetic circuit portion arranged on a magnetic conductive yoke, the central magnetic circuit portion comprising stripe-type central magnetic steel;

the side magnetic circuit portion comprises two side magnetic steels, the two side magnetic steels being separately arranged on two sides of the central magnetic steel, and magnetic gaps being formed between the central magnetic and the two side magnetic steels; and two extension portions are provided, the two extension portions being arranged corresponding to a periphery of two side edges of the central magnetic steel, separately.

11. The sound production apparatus according to claim 10, wherein the magnetic conductive comprises a rectangular flat plate structure, the two side steels arranged on two long side edges of the magnetic conductive yoke, the avoidance portion being an avoidance notch formed in a short side edge of the magnetic conductive yoke, and the extension portion passing through from the avoidance notch; or the magnetic conductive yoke comprises a rectangular flat plate structure, the two side magnetic steels arranged on two short side edges of the magnetic conductive yoke, the avoidance portion being an avoidance notch formed in a long edge side of the magnetic conductive yoke, and the extension portion passing through from the avoidance notch.

12. The sound production apparatus according to claim 10, wherein the magnetic circuit system is arranged in a circular ring shape.

13. The sound production apparatus according to claim 1, wherein the sound production apparatus further comprises an outer shell, and a first electric connector and a second electric connector arranged on the outer shell, wherein the first electric connector comprises a first internal bonding pad and a first external bonding pad arranged integrally;

the second electric connector comprises a second internal bonding pad and a second external bonding pad arranged integrally;

and the first external bonding pad and the second external bonding pad are electrically connected to an external circuit, two leading wires of the voice coil being electrically connected to the first internal bonding pad and the second internal bonding pad, separately.

14. The sound production apparatus according to claim 13, wherein the outer shell is arranged in a rectangular shape, a short shaft side of the outer shell is provided with a protrusion portion protruding from the outer shell, and the first external bonding pad and the second external bonding pad are located on the protrusion portion.

15. The sound production apparatus according to claim 13, wherein the outer shell is arranged in an annular shape, a side surface of the outer shell is provided with a protrusion portion protruding from the outer shell, and the first external bonding pad and the second external bonding pad are located on the protrusion portion.

16. The sound production apparatus according to claim 1, wherein the magnetic circuit system is arranged between the first diaphragm and the second diaphragm, and the voice coil is accommodated in a magnetic gap of the magnetic circuit system, a first sound cavity formed between the magnetic circuit system and the first diaphragm and a second sound cavity formed between the magnetic circuit system and the second diaphragm.

17. A portable terminal, comprising a housing, the housing provided with an accommodation cavity internally, wherein the portable terminal further comprises the sound production apparatus according to claim 1, the sound production apparatus mounted in the accommodation cavity, and the housing provided with a first sound hole corresponding to the first diaphragm and a second sound hole corresponding to the second diaphragm.

18. The portable terminal according to claim 17, wherein the housing is provided with a front surface and a back surface that are arranged oppositely, the first sound hole being formed in the front surface and the second sound hole being formed in the back surface.

* * * * *